US010273025B2

(12) United States Patent
Py

(10) Patent No.: US 10,273,025 B2
(45) Date of Patent: Apr. 30, 2019

(54) MODULAR FILLING APPARATUS AND METHOD

(71) Applicant: DR. PY INSTITUTE LLC, New Milford, CT (US)

(72) Inventor: Daniel Py, Larchmont, NY (US)

(73) Assignee: DR. PY INSTITUTE LLC, New Milford, CT (US)

( * ) Notice: Subject to any disclaimer, the term of this patent is extended or adjusted under 35 U.S.C. 154(b) by 456 days.

(21) Appl. No.: 14/636,954

(22) Filed: Mar. 3, 2015

(65) Prior Publication Data

US 2015/0175281 A1 Jun. 25, 2015

Related U.S. Application Data

(62) Division of application No. 13/861,502, filed on Apr. 12, 2013, now Pat. No. 8,966,866.
(Continued)

(51) Int. Cl.
*B65B 3/00* (2006.01)
*B65B 55/04* (2006.01)
(Continued)

(52) U.S. Cl.
CPC ..... *B65B 3/003* (2013.01); *B65B 51/02* (2013.01); *B65B 55/04* (2013.01); *B65B 55/08* (2013.01);
(Continued)

(58) Field of Classification Search
CPC ..... B65B 3/003; B65B 55/10; B65B 51/02; B65B 61/002; A61B 17/07207;
(Continued)

(56) References Cited

U.S. PATENT DOCUMENTS 3,637,102 A * 1/1972 Shaw ..... B65D 51/002 215/247
4,045,939 A * 9/1977 Baumstingl ..... B65B 31/02 422/41
(Continued)

FOREIGN PATENT DOCUMENTS

EP 2420450 A1 2/2012
JP 2005-529817 A 10/2005
(Continued)

OTHER PUBLICATIONS

Supplementary European Search Report dated Nov. 13, 2015 for European Patent Application No. 13775294.5. 7 pages.
(Continued)

*Primary Examiner* — Robert Long
(74) *Attorney, Agent, or Firm* — McCarter & English, LLP

(57) ABSTRACT

An apparatus and method for sterile filling comprises decontaminating a needle penetrable surface of a device including a needle penetrable septum and a sealed chamber in fluid communication with the needle penetrable septum. A filling needle penetrates the needle penetrable septum, introduces substance through the filling needle and into the chamber and is, in turn, withdrawn from the septum. A liquid sealant is applied to the penetrated region of the septum. Radiation or energy is applied to the liquid sealant to cure the liquid sealant from a liquid phase to a solid phase.

42 Claims, 16 Drawing Sheets

Related U.S. Application Data

(60) Provisional application No. 61/686,867, filed on Apr. 13, 2012.

(51) Int. Cl.

| | |
|---|---|
| ***B65B 51/02*** | (2006.01) |
| ***B65B 55/08*** | (2006.01) |
| ***B65B 61/00*** | (2006.01) |
| ***B65B 55/10*** | (2006.01) |
| *B65B 7/16* | (2006.01) |
| *B65B 39/00* | (2006.01) |

(52) U.S. Cl.
CPC ..... *B65B 55/10* (2013.01); *B65B 61/002* (2013.01); *B65B 7/16* (2013.01); *B65B 2039/009* (2013.01)

(58) Field of Classification Search
CPC ..... A61B 17/072; A61B 17/105; A61B 17/07292; A61B 2017/07271; A61B 2017/00893; A61L 31/16; A61L 31/148
USPC ... 53/79, 510, 403, 407, 408, 432, 425, 426, 53/434, 467
See application file for complete search history.

(56) References Cited

U.S. PATENT DOCUMENTS

| | | | | | |
|---|---|---|---|---|---|
| 4,409,775 | A * | 10/1983 | Brody | A23B 7/10 | 134/152 |
| 4,417,607 | A * | 11/1983 | Scholle | B65B 55/022 | 134/134 |
| 4,424,659 | A * | 1/1984 | Perigo | B65B 31/028 | 426/129 |
| 5,195,298 | A * | 3/1993 | Baranowski | B65B 55/02 | 156/281 |
| 5,829,228 | A * | 11/1998 | Mogard | B65D 5/746 | 493/105 |
| 5,884,457 | A * | 3/1999 | Ortiz | B65B 7/2835 | 53/167 |
| 6,050,435 | A * | 4/2000 | Bush | B65D 47/2031 | 215/249 |
| 6,120,730 | A * | 9/2000 | Palaniappan | B65B 55/025 | 422/28 |
| 6,351,924 | B1 * | 3/2002 | Gustafsson | A61L 2/186 | 53/425 |
| 6,536,648 | B2 * | 3/2003 | Flannery | B65C 7/006 | 227/140 |
| 7,096,896 | B2 | 8/2006 | Py | | |
| 7,100,646 | B2 * | 9/2006 | Py | A61J 1/1406 | 141/237 |
| 7,162,848 | B2 * | 1/2007 | Jacobs | B65B 55/10 | 53/111 R |
| 7,581,367 | B2 * | 9/2009 | Bechini | B67C 7/0073 | 422/292 |
| 7,628,184 | B2 | 12/2009 | Py et al. | | |
| 7,707,807 | B2 * | 5/2010 | Py | B65B 3/003 | 53/284.5 |
| 7,906,134 | B2 * | 3/2011 | Hauenstein | A61L 29/10 | 424/423 |
| 7,954,521 | B2 * | 6/2011 | Py | B65D 51/002 | 141/329 |
| 8,376,003 | B2 | 2/2013 | Py et al. | | |
| 8,885,116 | B2 * | 11/2014 | Bayne | G02F 1/133308 | 349/153 |
| 8,966,866 | B2 * | 3/2015 | Py | B65B 55/04 | 53/426 |
| 2002/0078831 | A1 * | 6/2002 | Cai | A47J 31/14 | 99/295 |
| 2004/0060261 | A1 * | 4/2004 | Py | A61L 2/08 | 53/425 |
| 2004/0222224 | A1 * | 11/2004 | Plester | B67C 7/008 | 220/203.17 |
| 2004/0256026 | A1 | 12/2004 | Py | | |
| 2005/0194059 | A1 | 9/2005 | Py | | |
| 2005/0217211 | A1 * | 10/2005 | Py | B29C 45/006 | 53/426 |
| 2006/0037884 | A1 | 2/2006 | Doyle et al. | | |
| 2006/0100408 | A1 | 5/2006 | Powell et al. | | |
| 2007/0283666 | A1 * | 12/2007 | Py | A61J 1/1406 | 53/425 |
| 2011/0084098 | A1 | 4/2011 | Py | | |
| 2012/0021107 | A1 * | 1/2012 | Knowlton | A23B 7/0056 | 426/394 |
| 2012/0090727 | A1 * | 4/2012 | Hundeloh | B65B 3/18 | 141/1 |
| 2012/0097705 | A1 * | 4/2012 | Py | B67D 3/043 | 222/83 |
| 2013/0008137 | A1 * | 1/2013 | Py | B65B 55/10 | 53/425 |
| 2013/0318926 | A1 | 12/2013 | Py | | |
| 2014/0027402 | A1 | 1/2014 | Py et al. | | |
| 2017/0158365 | A1 * | 6/2017 | Py | B65B 55/04 | |

FOREIGN PATENT DOCUMENTS

| | | | |
|---|---|---|---|
| JP | 2006516906 | A | 7/2006 |
| JP | 2007289641 | A | 11/2007 |
| KR | 10-2007-0052326 | A | 5/2007 |
| RU | 2140383 | C1 | 10/1999 |
| WO | 97/36785 | A1 | 10/1997 |
| WO | 2012177933 | A1 | 12/2012 |
| WO | 2014145313 | A2 | 9/2014 |

OTHER PUBLICATIONS

International Search Report and Written Opinion of the International Searching Authority for International Application No. PCT/US13/36296, dated Aug. 30, 2013.

* cited by examiner

MODULAR FILLING APPARATUS AND METHOD

CROSS-REFERENCE TO RELATED APPLICATION

This patent application is a divisional of U.S. patent application Ser. No. 13/861,502, filed Apr. 12, 2013, now U.S. Pat. No. 8,966,866, which claims priority to U.S. Provisional Patent Application No. 61/686,867, filed Apr. 13, 2012, all of which are incorporated herein by reference.

FIELD OF THE INVENTION

The present invention relates to apparatus and methods for aseptic filling, and more particularly, to apparatus and methods for aseptic filling sealed empty devices with filling members and resealing the resulting penetration apertures.

BACKGROUND INFORMATION

Apparatuses and methods for aseptic filling invented by the present inventor involve sterilizing a sealed empty device, such as a vial, introducing a needle through a resealable stopper of the vial to sterile fill the interior of the vial with a medicament or other substance, withdrawing the needle from the stopper, and applying laser radiation to the resulting penetration aperture to thermally reseal the penetration aperture and, in turn, hermetically seal the aseptically filled substance within the vial. Exemplary apparatuses and methods are disclosed in the following patents and patent applications which are hereby expressly incorporated by reference as part of the present disclosure: U.S. patent application Ser. No. 08/424,932, filed Apr. 19, 1995, entitled "Process for Filling a Sealed Receptacle under Aseptic Conditions," issued as U.S. Pat. No. 5,641,004; U.S. patent application Ser. No. 09/781,846, filed Feb. 12, 2001, entitled "Medicament Vial Having a Heat-Sealable Cap, and Apparatus and Method for Filling Vial," issued as U.S. Pat. No. 6,604,561, which, in turn, claims priority from U.S. Provisional Patent Application Ser. No. 60/182,139, filed Feb. 11, 2000, entitled "Heat-Sealable Cap for Medicament Vial;" U.S. patent application Ser. No. 10/655,455, filed Sep. 3, 2003, entitled "Sealed Containers and Methods of Making and Filling Same," issued as U.S. Pat. No. 7,100,646, which, in turn, claims priority from similarly titled U.S. Provisional Patent Application Ser. No. 60/408,068, filed Sep. 3, 2002; and U.S. patent application Ser. No. 10/766,172, filed Jan. 28, 2004, entitled "Medicament Vial Having a Heat-Sealable Cap, and Apparatus and Method for Filling the Vial," issued as U.S. Pat. No. 7,032,631, which, in turn claims priority from similarly titled U.S. Provisional Patent Application Ser. No. 60/443,526, filed Jan. 28, 2003 and similarly titled U.S. Provisional Patent Application Ser. No. 60/484,204, filed Jun. 30, 2003. Such apparatuses and methods represent a substantial improvement over prior art filling apparatus and methods, such as those that fill open containers. However, the apparatuses and methods require a resealable stopper that can absorb the laser radiation, convert it to heat and, in turn, locally melt the stopper at the penetration aperture to reseal it. In some such prior art apparatus and methods, the sealed empty devices are sterilized prior to needle filling by applying gamma and/or ebeam radiation, or a fluid sterilant, such as vaporized hydrogen peroxide ("VHP"), to at least the penetrable surfaces of the devices to achieve or otherwise ensure a desired sterility assurance level ("SAL") on the needle penetrable surfaces.

It is an object of the present invention to overcome one or more of the drawbacks and/or disadvantages of the prior art.

SUMMARY OF THE INVENTION

In accordance with a first aspect, a method comprising the following steps:

(i) de-contaminating at least a surface penetrable by a needle or other filling or injection member of a device including a penetrable septum or portion and a sealed chamber in fluid communication with the septum;

(ii) moving at least one of the filling member and the device relative to the other to penetrate the septum with the filling member and place the filling member in fluid communication with the chamber of the device, introducing substance through the filling member and into the chamber, and withdrawing the filling member from the septum;

(iii) applying a liquid sealant onto the penetrated region of the septum; and (iv) applying radiation or energy to the liquid sealant to cure the liquid sealant from a liquid phase to a solid phase.

In some embodiments, step (iv) further includes applying radiation or energy to the liquid sealant and curing the liquid sealant from a liquid phase to a solid phase substantially at room temperature. Some embodiments further comprise introducing an overpressure of sterile air or other gas over the device during each of steps (ii) through (iii). Some embodiments further comprise introducing an overpressure of sterile air or other gas over the device during each of steps (i) through (iv). Some embodiments further comprise applying a higher pressure of sterile air or other gas during step (ii) as compared to either of steps (i) or (iii) to create a positive pressure gradient between a filling station and de-contamination and curing stations.

In some embodiments, step (i) includes introducing the device into a de-contamination station and de-contaminating at least the penetrable surface of the septum within the de-contamination station; step (ii) includes moving the de-contaminated device into the filling station including at least one filling needle or filling of injection member coupled in fluid communication with a source of substance to be filled into the chamber of the device, moving at least one of the filling needle and the device relative to the other within the filling station to penetrate the septum with the filling needle, introducing substance through the filling needle and into the chamber, and withdrawing the filling needle from the septum; step (iii) includes moving the filled device from the filling station into a resealing station and applying a liquid sealant onto the penetrated region of the septum within the resealing station; and step (iv) includes moving the filled device from the filling station into a curing station and applying radiation or energy to the liquid sealant to cure the liquid sealant from a liquid phase to a solid phase in the curing station.

In some embodiments of the present invention, step (i) includes applying UV radiation to at least the penetrable surface of the septum. The UV radiation includes a wavelength or spectrum within the range of about 220 nm to about 300 nm, such as within the range of about 240 nm to about 280 nm, and is applied at a power within the range of about 40 W to about 80 W, such as within the range of about 50 W to about 70 W, for example at about 60 Watts. In some embodiments of step (iv) includes applying UV radiation at a wavelength or spectrum within the range of about 200 nm to about 500 nm, such as within the range of about 300 nm to about 400 nm, and at an irradiation intensity within the range of about ½ W/cm$^2$ to about 1½ W/cm$^2$, e.g., least 1.0

W/cm$^2$. Same embodiments further comprise curing the liquid sealant from a liquid phase to a solid phase within a time period of less than about one minute, which can be less than about ½ minute, or even less than about ⅓ minute.

In some embodiments of step (iv) includes moving a liquid sealant dispenser toward the septum to apply the liquid sealant, and then moving the dispenser away from the septum after applying the liquid sealant or vice versa, e.g. moving the septum. Some such embodiments further comprise breaking any filaments of liquid sealant extending between the septum and dispenser during relative movement of the dispenser and septum to allow such sealant to settle on the septum for curing.

In same embodiments, the septum is sufficiently elastic to close itself after withdrawal of the injection member or like from the septum and substantially prevent the liquid sealant from flowing through the penetrated region of the septum and into the chamber of the device. Likewise, the liquid sealant can be sufficiently viscous to also prevent the liquid sealant from flowing through the penetrated region of the septum and into the chamber of the device prior to curing the liquid sealant from the liquid phase to the solid phase.

In accordance with another aspect, the apparatus compromises a conveyor defining a path for transporting at least one device along the path. Each device includes a penetrable septum and a sealed chamber in fluid communication with the septum. A de-contamination station is located on along conveyor path and is configured to receive the device and to de-contaminate at least the penetrable surface of the septum. A filling station is located along the conveyor path downstream of the de-contamination station and includes at least one filling needle or injection or filling member coupled or coupleable in fluid communication with a source of substance to be filled into the chamber of the device. The filling instrument and/or the device is movable relative to the other within the filling station to penetrate the septum with the filling instrument, introduce substance through the filling instrument and into the chamber, and withdraw the filling instrument from the septum. A resealing station is located along the conveyor path downstream of the filling station and includes at least one liquid sealant dispenser coupled or coupleable in fluid communication with a source of liquid sealant for applying liquid sealant, e.g., a substantially metered amount of sealant, onto the penetrated region of the septum. A curing station is located along the conveyor path downstream of the filling station and includes at least one radiation or energy source for applying energy or radiation to the liquid sealant to cure the liquid sealant from a liquid phase to a solid phase.

Embodiments further comprise at least one source of sterile air or other gas coupled in fluid communication with the de-contamination, filling, resealing and curing stations, and configured for introducing an overpressure of sterile air or other gas within each station. In some such embodiments, the source of sterile air or other gas introduces an overpressure of sterile air or other gas within the filling station at a higher pressure than in the de-contamination and curing stations to create a positive pressure gradient between the filling station and the de-contamination and curing stations.

Some embodiments further comprise a frame and one or more modules mounted on the frame. Each module includes a de-contamination station, a filling station, a resealing station and/or a curing station. Each module can further include a respective portion of the conveyor. If desired, each module can include a plurality of stations, and the stations may be the same types of stations or may be different types of stations. In some such embodiments, a first module includes a plurality of de-contamination stations, a second module located downstream of the first module along the conveyor path includes a plurality of filling stations, a third module located downstream of the filling module along the conveyor path includes a plurality of resealing stations, and a fourth module located downstream of the resealing module along the conveyor path includes a plurality of curing stations. Some such embodiments further comprise at least two curing stations for each resealing station to increase throughput and/or decrease cycle time i.e., to achieve desired cycle times as discussed above.

In some embodiments, each module includes a canopy movable between an open position and a closed position, and defining an enclosure within the module in the closed position. A fan and a filter can be coupled in fluid communication with the fan for pumping air or other gas through the filter to sterilize the air or other gas and introduce the sterile air or other gas into the enclosure. A conveyor module transports devices along the conveyor path within the respective module. An exhaust assembly can be coupled in fluid communication between the enclosure and ambient atmosphere to exhaust the overpressure of sterile air or other gas therethrough. An inlet can be defined at one end of the conveyor module, and an outlet can be defined at another end of the conveyor module. In some such embodiments, the canopy is mounted over the conveyor module and the exhaust assembly is mounted below the conveyor module. The conveyor module can define a plurality of exhaust apertures in fluid communication between the enclosure and exhaust assembly for the flow of sterile air or other gas therethrough and into the exhaust assembly.

In some embodiments, the frame includes first and second axially-elongated supports laterally spaced relative to each other, and the exhaust assembly (where present) of each of a plurality of modules is mounted to the first and second supports with the respective conveyor module located therebetween. In some embodiments, each conveyor module includes a magnetic rail, and the conveyor includes at least one carriage magnetically coupled to and drivable along the magnetic rail. The magnetic rails of a plurality of conveyor modules can define a substantially continuous conveyor path. In some embodiments, the exhaust assembly includes a lower exhaust assembly and an upper exhaust assembly located on an opposite side of the first and second supports relative to the lower exhaust assembly and coupled thereto. In some such embodiments, the lower and/or upper exhaust assemblies include a conveyor rail mounted between the first and second supports and defining flow apertures therebetween. A plurality of exhaust ports can be coupled in fluid communication between the flow apertures and ambient atmosphere for exhausting sterile air or other gas therethrough and out of the enclosure.

In some embodiments, each of a plurality of modules includes first and second upstanding supports mounted on opposite sides of the conveyor rail relative to each other. The upstanding supports are configured for supporting a needle, injection member, or filling member, a liquid sealant dispenser and/or a radiation or energy source. In some such embodiments, the first and second upstanding supports support a needle and/or a liquid sealant dispenser, and are movable toward and away from the conveyor. In some such embodiments, the first and second supports support (i) a radiation or energy source for de-contaminating devices and/or (ii) a radiation or energy source for curing liquid sealant from a liquid phase to a solid phase.

Some embodiments further comprise a first sterile connector and a first fluid conduit coupled between the first sterile connector and the needle, and a second sterile connector and a second fluid conduit coupled between the second sterile connector and a source of substance to be filled. The first sterile connector is connectable to the second sterile connector to form a sealed sterile fluid connection therebetween. Such apparatus may further comprise a third sterile connector and third fluid conduit coupled between the third sterile connector and the liquid sealant dispenser, or a fourth sterile connector and a fourth fluid conduit coupled between the fourth sterile connector and a source of liquid sealant. The third sterile connector is connectable to the fourth sterile connector to form a sealed sterile fluid connection therebetween.

In some embodiments, the filling station includes a mount including a plurality of filling needles, injection members or filling members laterally spaced relative to each other and fixedly mounted thereon and a plurality of caps. Each cap is releasably connected to the mount in a position covering a respective needle or other filling/injection instrument. The mount is movable toward and away from the conveyor. The conveyor includes a cap fixture including a plurality of cap support surfaces engageable with respective caps when the mount is moved toward the conveyor to releasably retain the caps thereon, and disengage the caps from the mount when the mount is moved away from the conveyor to expose the needles, etc. and ready them for use.

In accordance with another aspect, to an apparatus comprises a conveyor defining a path for transporting one or more devices along the path and one or more modules. Each module includes (i) a de-contamination station located along the conveyor path and configured to receive therein the device and de-contaminate at least a surface of the device; (ii) a filling station located along the conveyor path downstream of the de-contamination station and including at least one filling member or the like coupled or coupleable in fluid communication with a source of substance to be filled into the chamber of the device; and/or (iii) a sealing station located along the conveyor path downstream of the filling station for sealing the filled device. In embodiments having a plurality of the modules, they are located (a) in series with each other, and/or (b) in parallel with each other. The modules can be configured to add additional modules in series or in parallel with such modules to increase throughput or decrease cycle time, and/or to remove one or more of the modules from the conveyor path to decrease throughput or increase the cycle time.

In some embodiments of, each device includes a penetrable septum as other penetrable portion and a sealed chamber in fluid communication therewith. Each of the modules includes (i) a de-contamination station located along the conveyor path and configured to receive therein the device and de-contaminate at least the penetrable surface of the penetrable septum; and (ii) a filling station located along the conveyor path downstream of the de-contamination station and including at least one filling member or like coupleable in fluid communication with a source of substance to be filled into the chamber of the device. The filling needle and/or the device is movable relative to the other within the filling station to penetrate the penetrable portion with the filling needle, introduce substance through the filling needle and into the chamber, and withdraw the filling needle from the septum. A resealing station is located along the conveyor path downstream of the filling station and includes at least one liquid sealant dispenser coupleable or coupled in fluid communication with a source of liquid sealant for applying the liquid sealant onto the penetrated region of the septum. A curing station is located along the conveyor path downstream of the filling station and includes at least one radiation or energy source for applying radiation or energy to the liquid sealant to cure the liquid sealant from a liquid phase to a solid phase.

Some embodiments further comprise one or more frames. The modules are mounted on the frame(s). Each module includes a canopy movable between an open position and a closed position, and each canopy defines an enclosure within the module in the closed position. A fan is coupled in fluid communication with each enclosure, and a filter is coupled in fluid communication with each fan for pumping air or other gas through the filter to sterilize the air or other gas and introduce the sterile air or other gas into the respective enclosure. A conveyor module transports devices along the conveyor path within each respective module. An exhaust assembly can be coupled in fluid communication between each respective enclosure and ambient atmosphere to exhaust the overpressure of sterile air or other gas therethrough. A module inlet can be defined at one end of each conveyor module, and a module outlet can be defined at another end of each conveyor module.

In some embodiments of a plurality of modules are mounted in series relative to each other along the conveyor path. Each module defines an inlet at one end of the respective conveyor module, and an outlet at the opposite end of the respective conveyor module. Each of a plurality of outlets defines the inlet of an adjacent module. In some embodiments, each conveyor module includes a magnetic rail, the magnetic rails of the modules define the conveyor path, and the conveyor includes at least one carriage magnetically coupled to and drivable along the magnetic rails of the modules.

One advantage of the invention is that the radiation or energy curing of the liquid sealant substantially decreases cycle time in comparison to apparatus and methods without such curing, and therefore increases the throughput of such apparatus and methods. Yet another advantage is that the modular construction of the apparatus allows modules to be added to the apparatus to increase throughput and/or to decrease cycle time. For example, the apparatus can include more of the relatively time-consuming (or higher cycle time) stations in comparison to the relatively less time-consuming (or lower cycle time) stations in order to decrease overall cycle time and increase throughput. In one such example, the apparatus and method includes more curing stations in comparison to resealing stations where the curing requires more time than application of the liquid sealant. Yet another advantage is that additional modules can be added in series and/or in parallel to the other modules to enhance flexibility with respect to the footprint of the apparatus.

Other advantages of the present invention, and/or of the embodiments thereof, will become more readily apparent in view of the following detailed description of the currently preferred embodiments and accompanying drawings.

DETAILED DESCRIPTION OF EMBODIMENTS OF THE INVENTION

Figure 1:
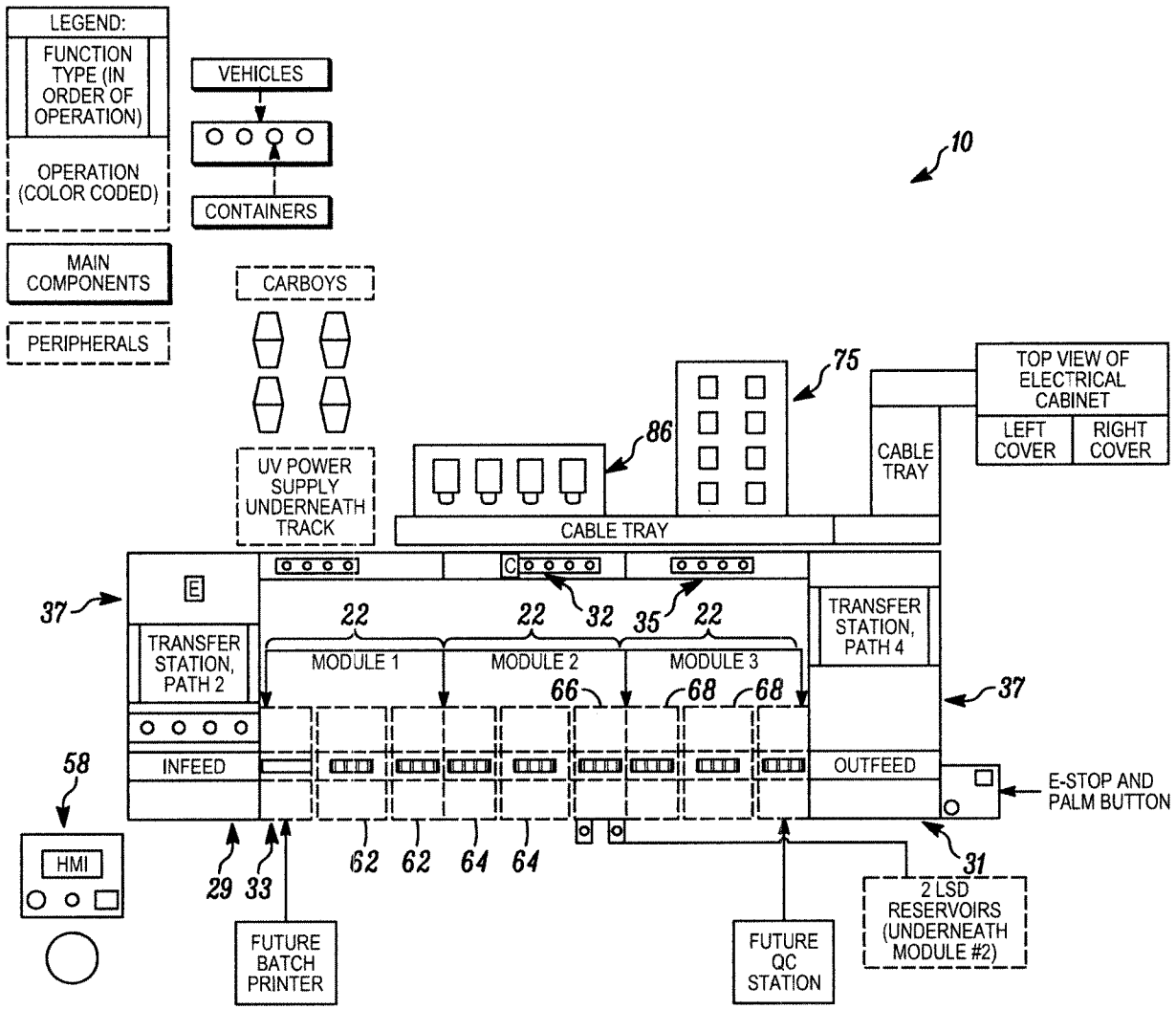
FIG. 1 is a schematic view of an aseptic or sterile filling apparatus having modules containing a de-contamination station, a filling station, a resealing station and a curing station.

In FIG. 1, one embodiment of an aseptic or sterile filling apparatus is indicated generally by the reference numeral 10. The aseptic or sterile filling apparatus 10 is used to fill devices 12, such as containers or delivery devices for storing and dispensing liquid products, such as beverages, food, or nutritional products, vials or syringes for containing and/or dispensing any of numerous different types of products or substances, such as medicaments, vaccines, pharmaceuticals, dermatological products, ophthalmic products, and nutritional supplements, devices for storing and dispensing cosmetic or cosmeceutical products, or devices for storing and dispensing industrial products. As should be recognized by those of ordinary skill in the pertinent art based on the teachings herein, the aseptic or sterile filling apparatus 10 may be used for filling any of numerous different types of devices that are currently known or that later become known, including devices having penetrable or portions or septums and/or sealed chambers in fluid communication therewith, with any of numerous different types of substances that are currently known or that later become known.

Figure 2:
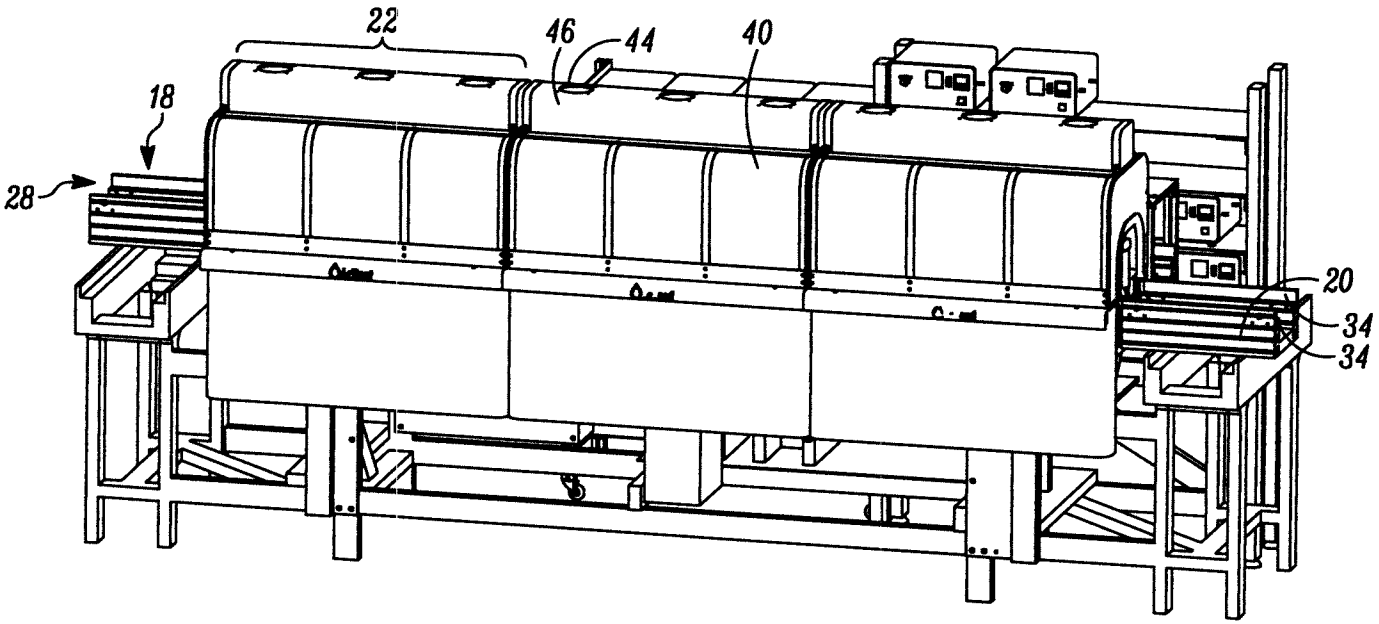
FIG. 2 is a perspective view of a portion of the aseptic or sterile filling apparatus of FIG. 1.

As shown in FIG. 2, the aseptic or sterile filling apparatus 10 includes a series of workstations for performing respective functions on a device(s) 12 within the aseptic or sterile filling apparatus 10. It will be understood that the aseptic or sterile filling apparatus 10 may include one or more workstations discussed below or any suitable combination thereof. In certain applications, the aseptic or sterile filling apparatus 10 is capable of bypassing one or more workstations. Additionally, one or more workstations can be substituted for others based on the desired application.

Figure 3:
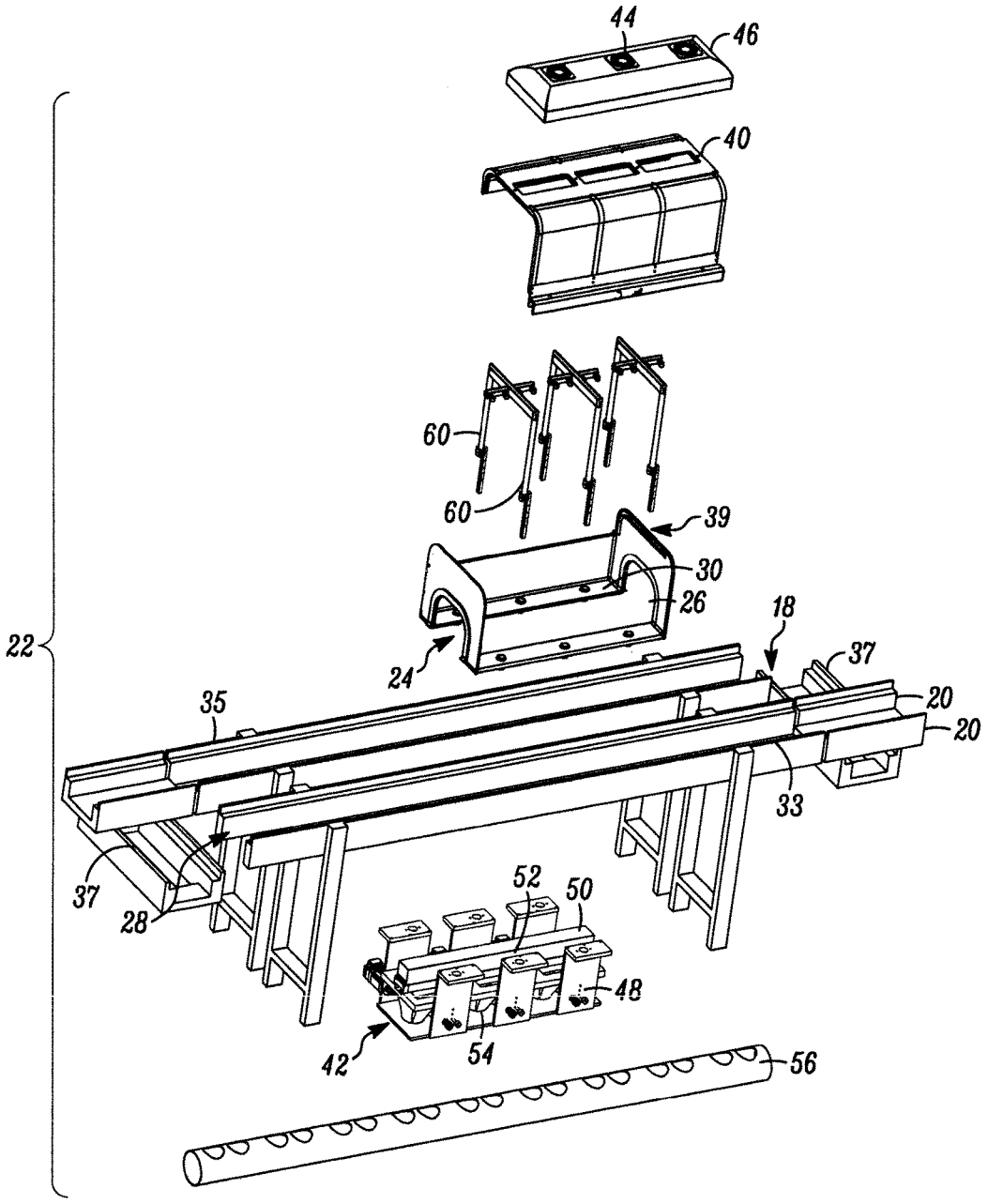
FIG. 3 is an exploded, perspective view of a module of the aseptic or sterile filling apparatus of FIG. 1.
Figure 4:
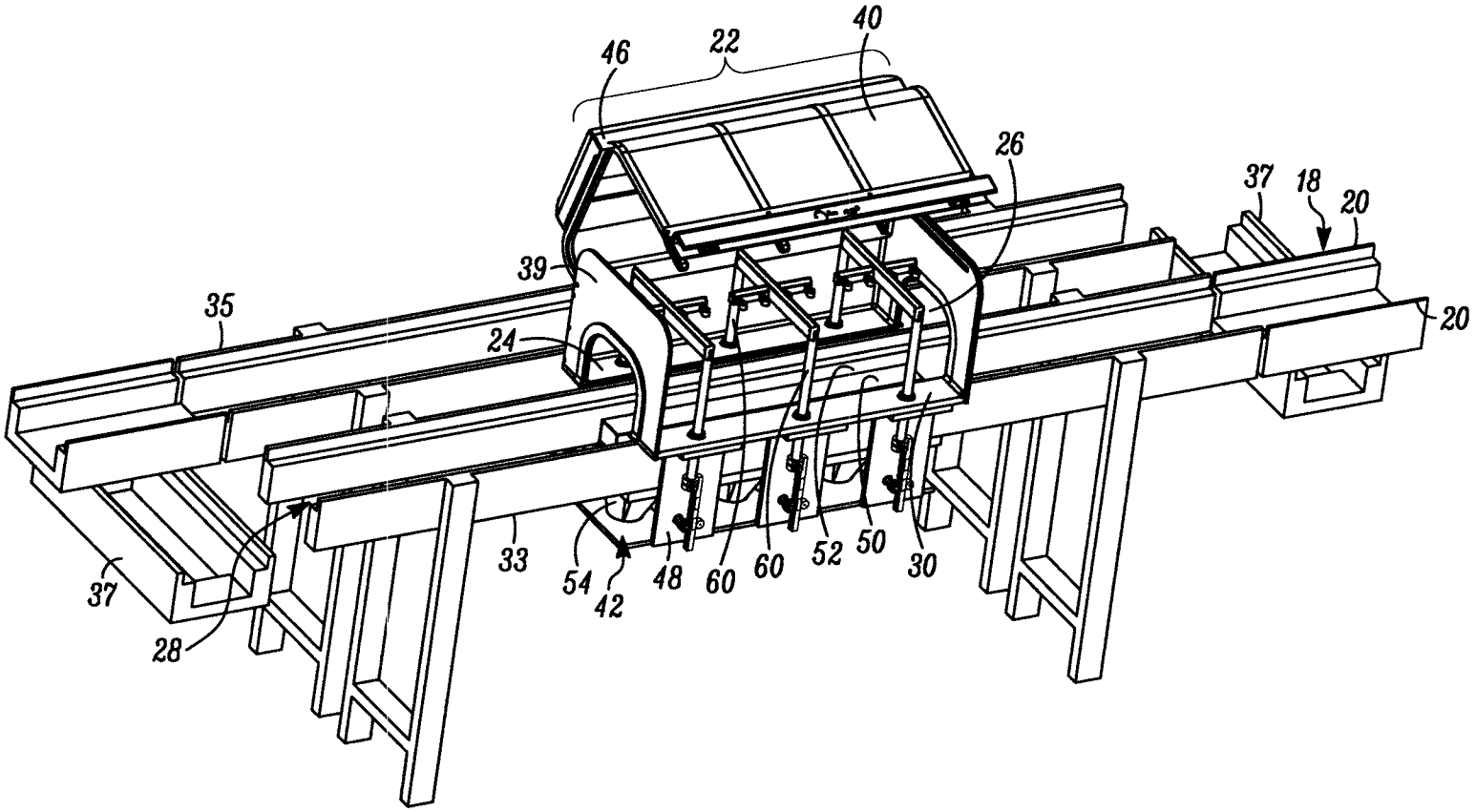
FIG. 4 is a perspective view of a single module mounted on a frame of the aseptic or sterile filling apparatus of FIG. 1, having a canopy in an open position.

The aseptic or sterile filling apparatus 10 includes a frame 18, having first and second axially-elongated supports 20 laterally spaced apart, for supporting a plurality of modules 22 mounted in series thereon. As shown in FIGS. 3 and 4, each module 22 defines an inlet 24 at one end of the module, and an outlet 26 at the opposite end of the respective module, where the outlet of one module defines the inlet of an adjacent module. At least one workstation is enclosed within each module, each workstation having an operational element configured for a specific operation, as described further below. The apparatus 10 also includes a conveyor 28, comprised of a plurality of conveyor modules 30, as described further below, and forming an axially-elongated and substantially continuous conveyor path between the first and second axially-elongated supports 20. As shown in FIG. 1, the conveyor 28 includes a loading station 29, defining an inlet to the conveyor, and a discharge station 31, defining an outlet to the conveyor. In the illustrated embodiment, and as shown in FIGS. 1 and 3, the conveyor 28 includes a working conveyor 33, a return conveyor 35, and two end conveyors 37. The working conveyor 33 transports carriages 32 along the conveyor path from the loading station 29, through the modules 22, to the discharge station 31. The return conveyor 35 extends between the discharge station 31 to the inlet station 29 and transports carriages 32 in an opposite direction from the working conveyor direction. In the illustrated embodiment, the return conveyor 29 does not pass through any modules 22. However, in the embodiments they may. The end conveyors 37 are moveable laterally between the working conveyor 33 and the return conveyor 35 to transport carriages 32 therebetween.

A carriage 32 may be configured to hold a single device 12 or a plurality of devices, where the plurality of devices may be the same or different types of devices. The first and second axially-elongated supports 20 of the frame 18 define first and second carriage tracks 34, respectively, wherein a carriage 32 slidably engages the carriage tracks. A carriage 32 may engage the carriage tracks 34 via, for example, bearings or rollers. Each carriage 32 includes a device fixture 36 extending from a base thereof, having a plurality of device support surfaces 38 engageable with respective devices 12 to support a device 12 in the fixture 36 and prevent movement of the devices 12 relative to the fixture 36 during transport.

The aseptic or sterile filling apparatus 10 further (optionally) includes a source of sterile air or other gas, to introduce an overpressure of sterile air or other gas into each of the modules 22. As may be recognized by those of ordinary skill in the pertinent art based on the teachings herein, any of numerous different sterile gases that are currently known, or that later become known may be utilized.

Turning to FIG. 3, an embodiment of a module 22 is described. Each module includes a upper assembly 39 mounted on one side of axially-elongated supports 20 of the frame 18 and an (optional) exhaust assembly 42 mounted on an opposite side of the axially-elongated supports relative to the upper assembly 39. In the illustrated embodiment, the upper assembly 39 is mounted on the upper side of the supports 20 and the exhaust assembly 42 is mounted on the lower side of the supports 20. A bottom surface of the upper assembly 39, lying on the axially-elongated supports 20, is a conveyor module 30. Brackets 48 of the exhaust assembly 42 attach to the conveyor module 30 of the upper assembly 39, thereby attaching the upper assembly 39 to the exhaust assembly 42.

Figure 5:
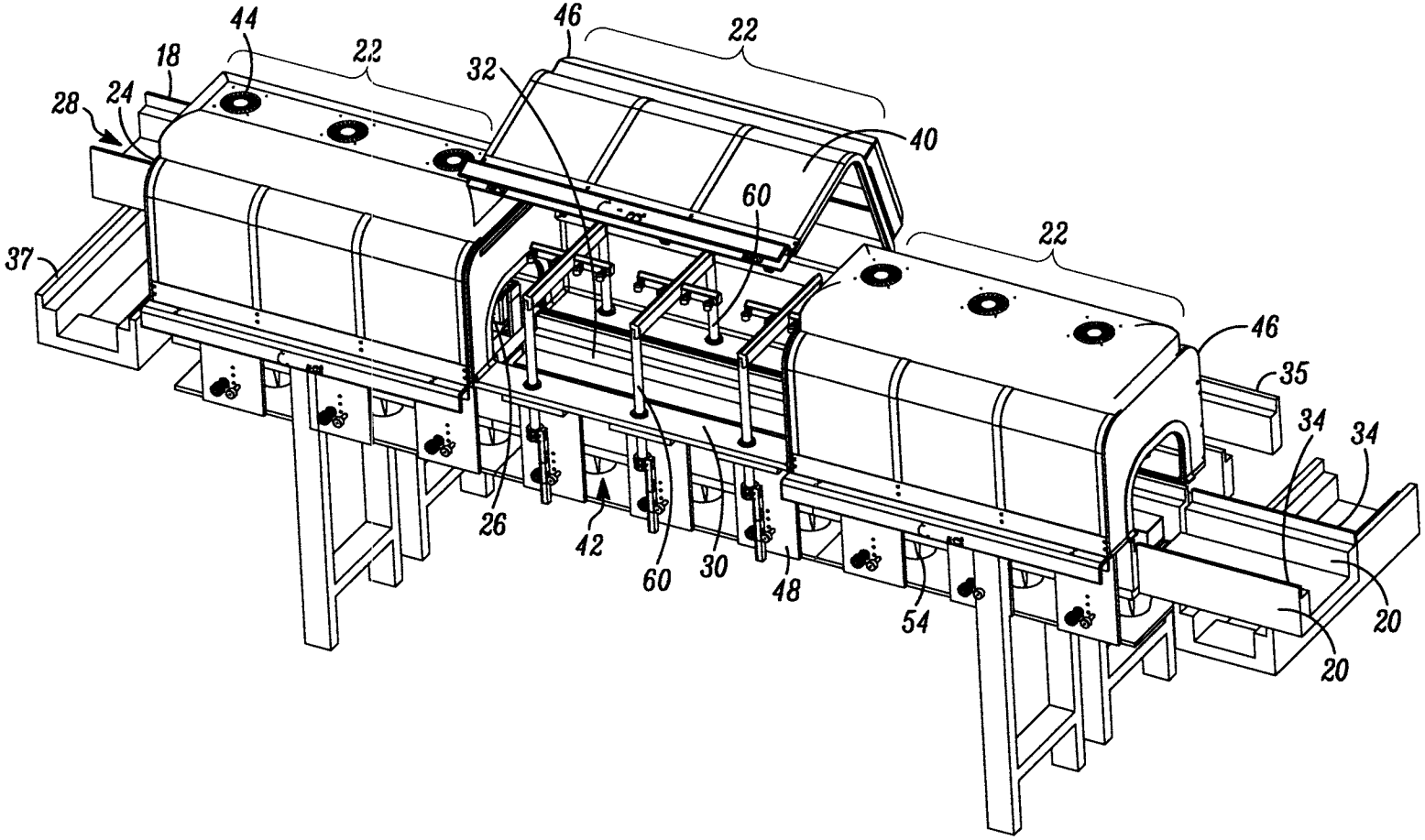
FIG. 5 is a perspective view of several adjacent modules on the frame of the aseptic or sterile filling apparatus of FIG. 1, with one of the modules having a canopy in an open position.
Figure 6:
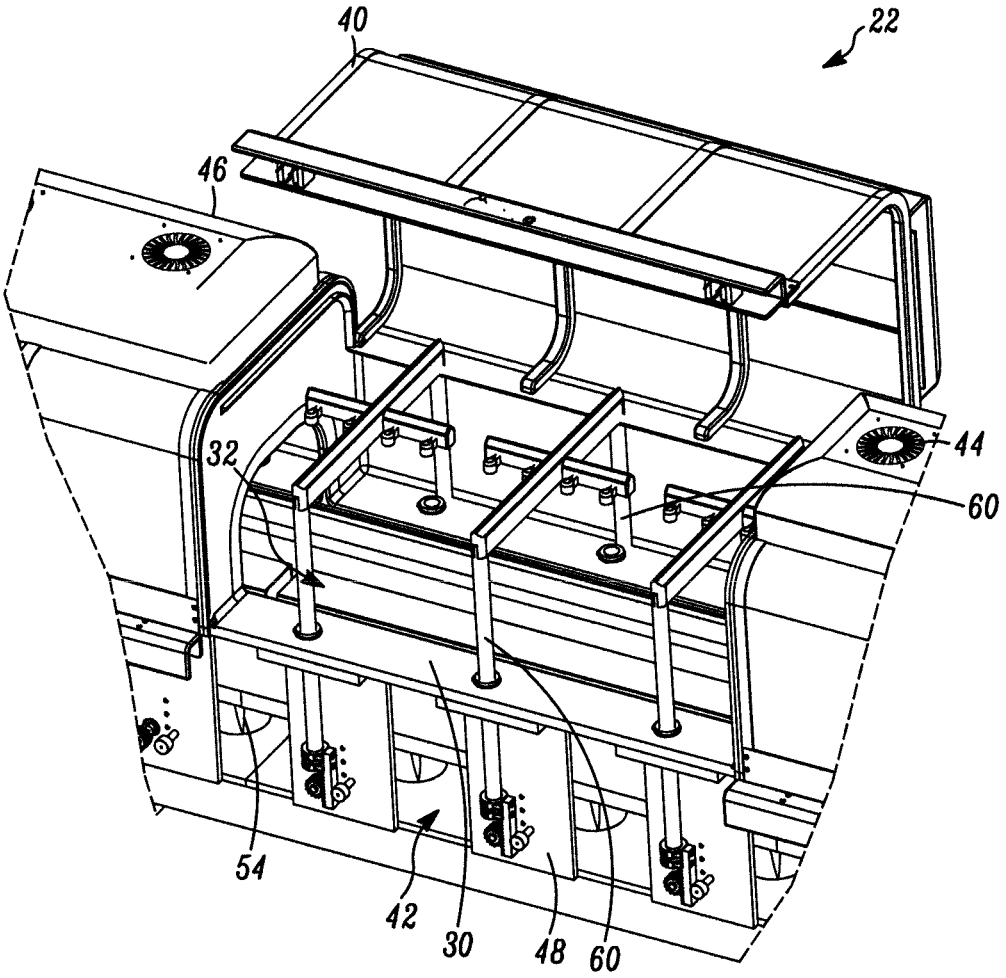
FIG. 6 is an enlarged view of one of the modules of FIG. 5, having a canopy in an open position and with carriages located therein.

As shown in FIGS. 4-6, each module also includes a canopy 40 covering the upper assembly 39 and moveable between open and closed positions. An enclosure is defined within a module 22 when the canopy 40 is in the closed position.

In the illustrated embodiment, each module 22 also includes at least one fan 44 and a filter 46 coupled in fluid communication with the fan 44 for pumping air or another gas from the source of air and through the filter 46 to introduce an overpressure of sterilized air or other gas into the enclosure. As seen in FIGS. 3 and 5, each fan 44 and filter 46 for a respective module 22 are located atop the canopy 40 of the module, in order to introduce an overpressure of air. As may be recognized by those of ordinary skill in the pertinent art based on the teachings herein, any of numerous filters that are currently known, or that later become known may be utilized, such as, for example, a high efficiency particulate air (HEPA) filter.

Figure 7:
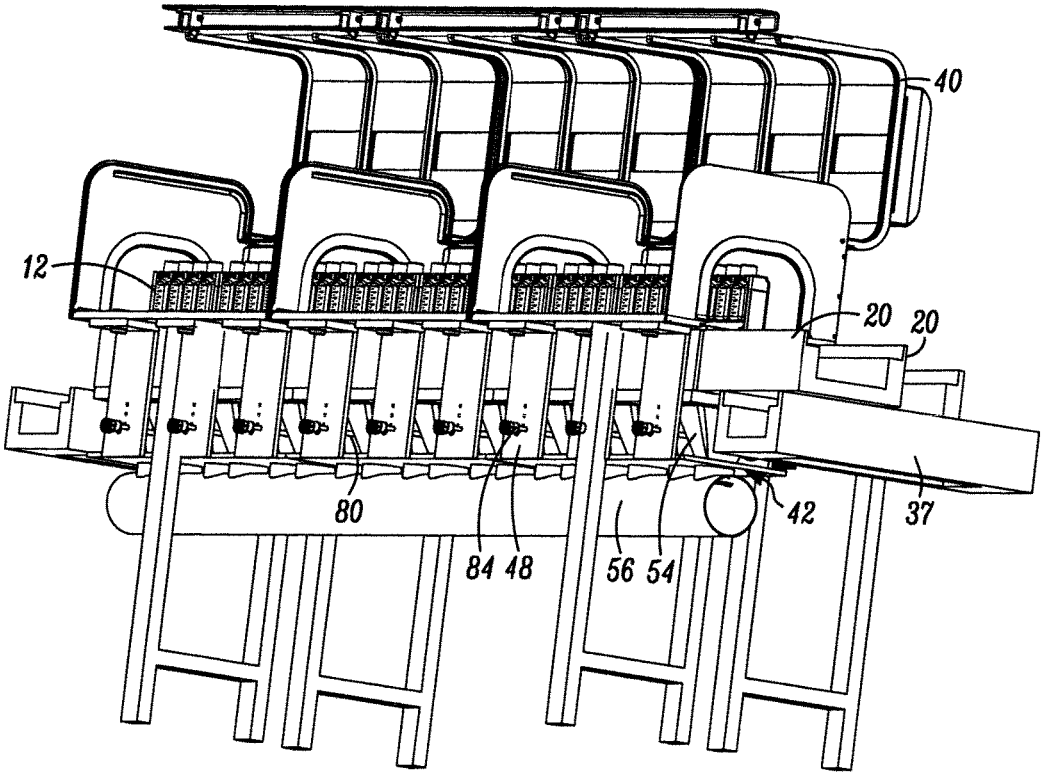
FIG. 7 is a perspective view showing exhaust assemblies mounted below axially-extending supports of the frame of the aseptic or sterile filling apparatus of FIG. 1.
Figure 8:
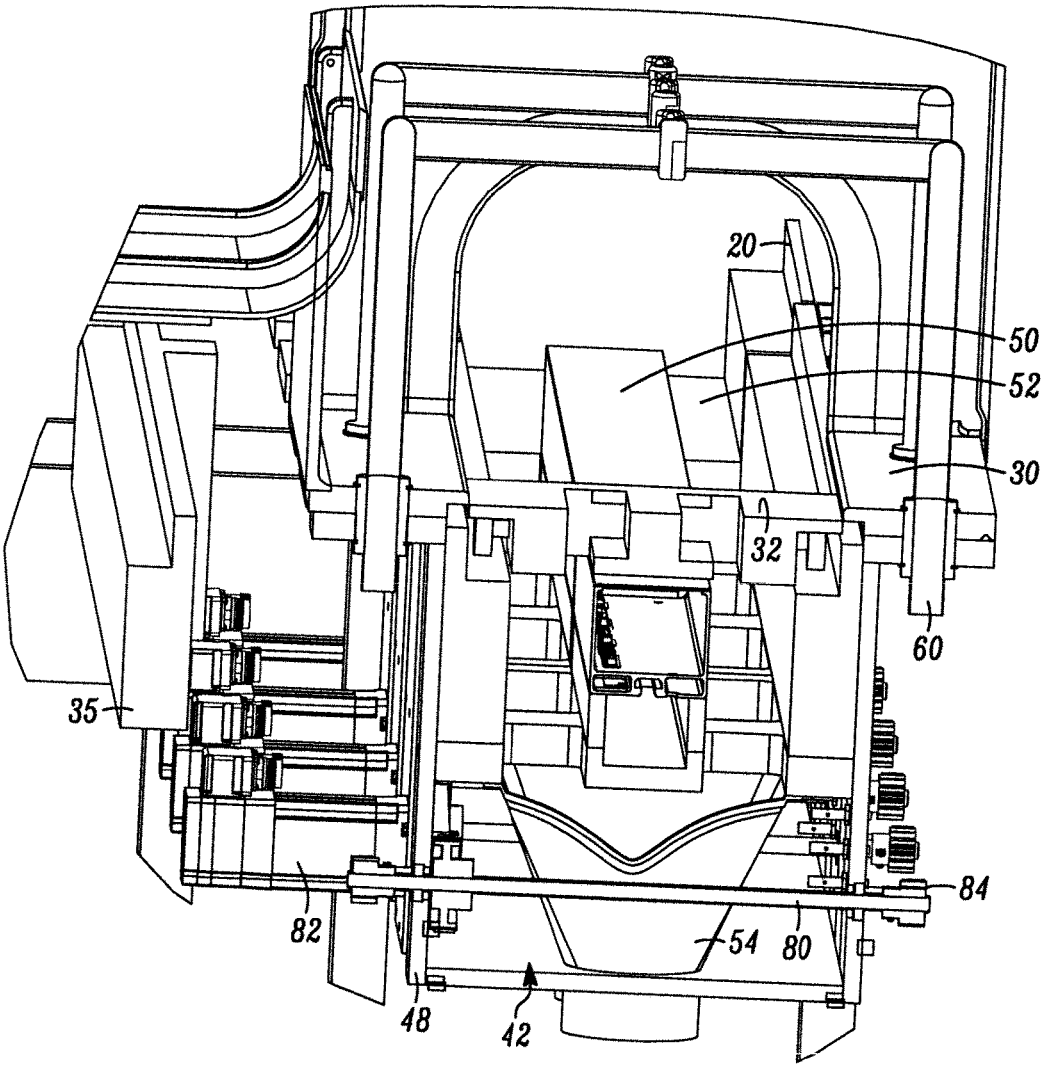
FIG. 8 is a cross sectional view of a module of the aseptic or sterile filling apparatus of FIG. 1.

As shown in FIGS. 3 and 4, the exhaust assembly 42 includes a conveyor rail 50 extending along the conveyor path and located between the first and second axially-elongated supports 20. A plurality of exhaust flow apertures 52 are defined by spaces between the conveyor rail 50 and the first and second axially-elongated supports 20. The exhaust flow apertures 52 allow the flow of the sterile air or other gas therethrough and out of the enclosure. The exhaust apertures may be axially-elongated and located on opposite sides of the conveyor rail 50 relative to each other. As shown in FIGS. 7 and 8, the exhaust assembly 42 also includes at least one exhaust port 54 mounted below the conveyor rail 50 and the apertures 52, and coupled in fluid communication therewith at one end and in fluid communication with an exhaust manifold 56 at the other end. The exhaust manifold 56 vents the sterile air or gas out to the ambient atmosphere. Thus, the sterile air or gas is vented out of an enclosure through the exhaust flow apertures 52, the exhaust port 54 and the exhaust manifold 56 and into the ambient atmosphere.

In the illustrated embodiment, the conveyor rail 50 is a magnetic rail to provide quick and efficient transport of the devices 12 between workstations, as well as precise positioning thereof in proper alignment with a workstation. The carriages 32 are magnetically coupled and drivable along the magnetic rail. The carriages 32 are transported along the magnetic rail via a motor, such as, for example, a linear synchronous motor, node controllers for controlling the carriages, and a control unit 58 to control the speed and position of an individual carriage. For example, in some embodiments it may be desirable to slow the carriages 32 or completely stop the carriages at or near a certain workstation. While the present disclosure discusses various stations, it will be understood that the carriages 32 need not stop at every workstation of the aseptic or sterile filling apparatus 10. Moreover, the conveyor 28 may be configured, using the control unit 58, to allow only certain carriages 32 to progress through a select number of stations and bypass other stations. Further, other types of conveyor systems may be used that are known or become known. For example, a belt conveyor may be used. Alternatively, the carriages 32 may be moved by other mechanisms, such as cable, belt, or direct drive motor using a friction drive or gear/rack type system.

As seen in FIGS. 3-6, each module 22 also includes first and second upstanding supports 60 mounted on opposite sides of the conveyor rail 50 to the conveyor module 30 for supporting at least one operational element of the respective workstation(s) located within the module. It will be noted that in FIGS. 4-6, the canopy of at least one module is in the open position to facilitate viewing the interior of the module.

Generally, the aseptic or sterile filling apparatus 10 includes a de-contamination station 62, a filling station 64, a resealing station 66 and a curing station 68 as seen in FIG. 1. The workstations are located along the conveyor path in this sequence so that the carriage 32 and devices 12 thereon pass through the workstations in this order. The de-contamination station 62 is the first station located on the conveyor path after the loading station 29. The de-contamination station 62 decontaminates at least the penetrable surface of the penetrable portion septum 14 via an energy or radiation source 70. The apparatus 10 further includes a filling station 64 located downstream of the de-contamination station 62. The needle filling station 64 includes a plurality of filling needles 72 or like injection or filling instruments that can be in fluid communication with a source of substance to be filled into the chamber 16 of a device 12. The apparatus 10 further includes a resealing station 66 located downstream of the filling station 64. The resealing station 66 includes one or more liquid sealant dispensers 74 placeable in fluid communication with a source of liquid sealant for applying a liquid sealant onto the penetrated region of a device septum 14. The liquid sealant can be applied in a substantially metered amount for consistency. The apparatus 10 further includes a curing station 68 located downstream of the resealing station 66. The curing station 68 includes at least one energy or radiation source 75 connected to a radiation or energy generating or emitting unit 76 for applying radiation or energy to the liquid sealant to cure the liquid sealant from a liquid phase to a solid phase.

As explained above, an overpressure of sterile air or gas can be introduced into each of the workstations. In some embodiments, the sterile air or gas is introduced into the filling station 64 at a higher pressure than in the de-contamination 62 and curing stations 68 to create a positive pressure gradient between the filling station and the de-contamination and curing stations. The workstations are hereinafter described in further detail.

Figure 9:
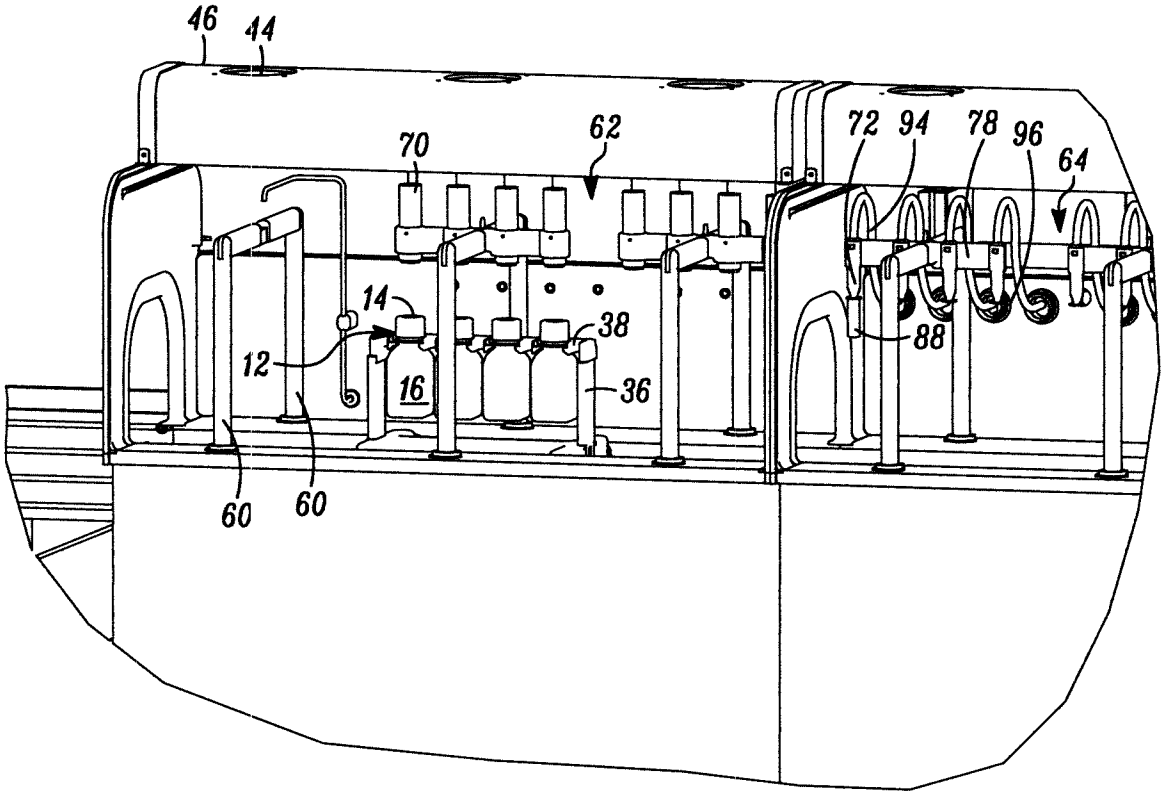
FIG. 9 is a front perspective view of a de-contamination station located within a module of the aseptic or sterile filling apparatus of FIG. 1, with the carriage carrying a set of devices aligned with the station therein to sterilize the device septums.

As seen in FIG. 9, the de-contamination station 62 is the first workstation in the sequence. The de-contamination station includes one or more energy or radiation sources 70 supported by the first and second upstanding supports 60 for sterilizing or at least de-contaminating a septum 14 of a device 12 prior to filling. In addition, the de-contamination station can be configured to decontaminate more than the penetrable portion 14 of the device 12. Suitable energy or radiation sources include gamma radiation, UV radiation and e-beam or beta radiation. Gamma radiation penetrates matter deeply and can be used to irradiate the inside and outside of the device 12. UV radiation can also be used in sterilizing the device 12 prior to filling. UV provides several advantages such as ease of use, low cost of installation and use and minimal damage to substrate materials. UV sterilization may be accomplished through either continuous wave UV sterilization or pulsed UV sterilization.

The use of pulsed UV light allows for quick and effective sterilization of the device 12 as it moves from one workstation to the next. The pulsed UV light can be provided by way of two four-channel de-contamination substations having Xenon flash lamps. Pulsed UV sterilization of a portion of the device 12 is accomplished using a pulse generator connected to a Xenon flash lamp. The pulse generator is utilized to trigger the required number of pulses per second for the Xenon flash lamps for successful sterilization of the device septum 14. For example, a 10 MHz pulse generator can be utilized to trigger the Xenon flash lamps greater than 470 times per second. A 2.0 MHz amplifier can be utilized to increase the trigger signal power distributed to the two four-channel substations. The Xenon flash lamps function at a wavelength or spectrum, for example, within the range of about 240 nm and about 280 nm, or within the range of about 254 nm and about 260 nm. In some embodiments, the lamps are operated within the range of about 400 VDC to about 1000 VDC, e.g., at about 800 VDC, at about 60 Watt power. It has been found that operation within the range of about 3 seconds and about 10 seconds is suitable, and in a number of applications, for a period of about 5 seconds at each de-contamination substation. In such embodiments, the devices 12 are de-contaminated for about 5 seconds under each of the two de-contamination substations for a total of about 10 seconds. A sterility assurance level (SAL) of at least about log 3 can thus be achieved for the device septums.

In embodiments where Xenon lamps are used, a fan or plurality of fans may be introduced to eliminate ozone and heat. In some embodiments, a single fan with a single sterile filter is used. In other embodiments, two or three fans are used to control flow, with the outlet of each fan being coupled to a sterile filter.

Figure 11:
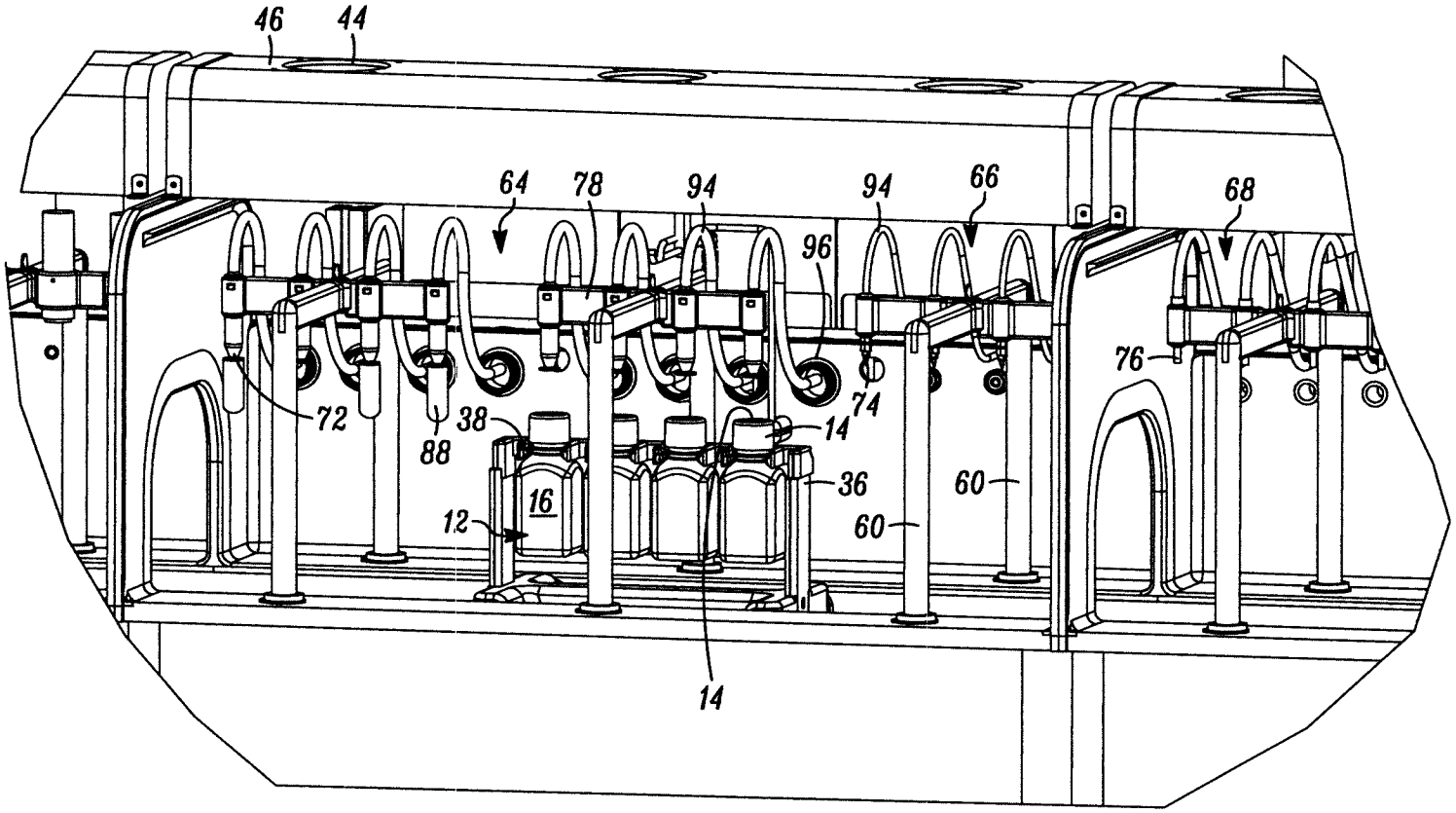
FIG. 11 is a front perspective view of the filling and resealing stations located within a module of the aseptic or sterile filling apparatus of FIG. 1, with a carriage carrying a set of the devices aligned with the filling station therein, and with the filling members in the raised position.

As shown in FIG. 1, the aseptic or sterile filling apparatus 10 further includes a needle filling station 64 as the second workstation in the sequence after the de-contamination station 62. In the illustrated embodiment, the needle filling station 64 is located in a different module than the de-contamination station 62. Alternatively, it may be located in the same module or another location. After the septums 14 of the devices 12 have been sterilized in the de-contamination station 62, the devices are transported downstream from the de-contamination station 62 to the filling station 64. As shown in FIG. 11, the filling station 64 includes a plurality of filling needles 72 or other injections or filling members laterally spaced relative to each other and fixedly mounted to a mount 78 that is supported by the first and second upstanding supports 60. As may be recognized by those of ordinary skill in the pertinent art based on the teachings herein, any of numerous filling needles or filling members that are currently known, or that later become known, may be utilized to fill a substance into the device. For example, a self opening and closing filling device may also be utilized to sterile fill the device(s) 12 in accordance with the teachings of U.S. patent application Ser. No. 13/450,306, filed Apr. 18, 2012, entitled "Needle with Closure and Method," which, in turn, claims the benefit of U.S. Provisional Patent Application Ser. No. 61/476,523, filed Apr. 18, 2011, entitled "Filling Needle and Method;" U.S. Provisional Patent Application Ser. No. 61/659,382, filed Jun. 13, 2012, entitled "Device with Penetrable Septum, Filling Needle and Penetrable Closure, and Related Method;" similarly titled U.S. Provisional Patent Application Ser. No. 61/799,744, filed Mar. 15, 2013; and U.S. Provisional Patent Application Ser. No. 61/798,210, filed Mar. 15, 2013, entitled "Controlled Non-Classified Filling Device and Method," which are hereby expressly incorporated by reference in their entireties as part of the present disclosure. Additionally, a single lumen non-coring needle may be utilized to dispense a substance into a device when there is no need to provide a venting channel for positive pressure within the device. Conversely, a double lumen non-coring needle may be utilized to dispense a substance into a device through the eye of the needle and also provide a venting channel between the inner and outer lumens to vent out to the atmosphere any positive pressure in the device at the inception of filling as well as pressure developed within the container during filling.

As shown in the embodiment of FIG. 8, the needle filling station 64, as well as the resealing station 66 described further below, also includes drive shafts 80 rotatably mounted between opposite sides of the exhaust assembly brackets 48 below the conveyor module 30, and having a drive motor 82 connected thereto. The first and second upstanding supports 60 in these stations extend through the conveyor module 30 and drivingly connect to the ends 84 of the drive shafts 80. Drive motors 82 rotatably drive the drive shafts 80 to move the first and second upstanding supports 60 toward and away from the devices 12. As may be recognized by those of ordinary skill in the pertinent art based on the teachings herein, any of numerous motors currently known, or that later become known, such as, for example, a Z axis servo motor, may be utilized to rotate the drive shafts and drive the upstanding supports toward and away from the devices.

Accordingly, when a carriage 32 is properly aligned with the filling station 64, the drive shaft 80 lowers the first and second upstanding supports 60, and thus the mount 78 holding the filling needles 72 toward the carriage 32, the filling needles 72 penetrate the penetrable septums 14 of the respective aligned devices 12, introduce a substantially metered amount of a substance therethrough and into the chambers 16 of the respective devices 12, and then the drive shaft 80 raises the mount 78 away from the devices 12 to withdraw the filling needles 72 therefrom. The drive motor 82 may be programmed to lower the filling needles 72 to an operator-specified stroke to ensure that the filling needles 72 are automatically lowered to the correct depth required for the tips of the filling needle to fully penetrate the penetrable portion or septum 14 of a respective device 12 and enter the device chamber 16. The specified stroke depends upon the device 12, e.g., its height in the carriage 32. Upon completion of the filling process, the filling needles 72 are raised, e.g., automatically back to their original location, ensuring that the filling needle tips have exited and cleared the respective device(s) 12.

In some embodiments, the filling station 64 also includes a pump 86, such as, for example, a peristaltic pump, connected between a source of substance and the filling needles 72 to ensure that the correct volume of substance is delivered to each device 12. As may be recognized by those of ordinary skill in the pertinent art based on the teaching herein, any of numerous pumps or metering devices currently known, or that later become known, may be utilized to ensure a correct amount of substance is delivered to each device.

In some embodiments, the filling station 64 also includes a valve, such as, for example, a pinch valve, connected between the source of substance and the filling needles 72 to isolate the substance from the eye of the needle for a drip-free environment as well as to isolate residual substance in the substance line when the dispensing of substance is complete. As should be recognized by those of ordinary skill in the pertinent art based on the teaching herein, any of numerous valves currently known, or that later become known, may be utilized to ensure that substance does not drip from the eye of a filling needle.

Figure 10:
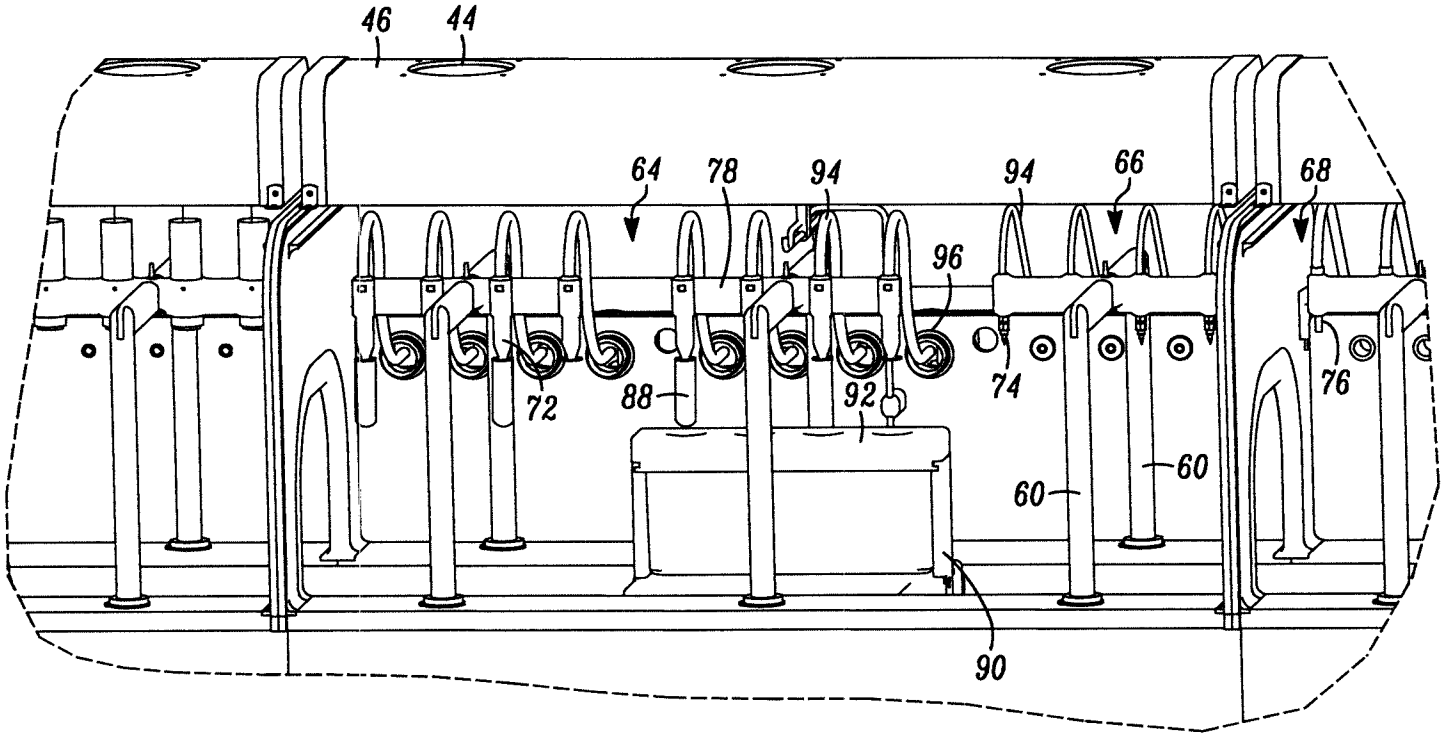
FIG. 10 is a front perspective view of the filling and resealing stations located within a module of the aseptic or sterile filling apparatus of FIG. 1, with a cap fixture to engage and release caps from a mount therefor.

As shown in FIG. 10, a plurality of caps 88 are disposed on the filling needles 72. Each cap 88 is releasably connected to the mount 78 in a position covering a respective filling needle 72. The conveyor 28 includes a cap fixture 90 having a plurality of cap support surfaces 92 engageable with respective caps 88. Prior to the passing of a carriage 32 carrying a set of devices 12, the mount 78 is moved toward the cap fixture 90 to releasably retain the caps 88 on the cap support surface 92, and disengage the caps 88 from the mount 78 when the mount is moved away from the cap fixture 90. This exposes the filling needles 72 and readies them for use. In this manner, caps 88 protect the filling needles 72 and maintain the sterility of said needles when the needles are not in use. Likewise, the caps may be configured to removably cover and/or protect other types of filling instruments in embodiments where such are used.

Figure 14:
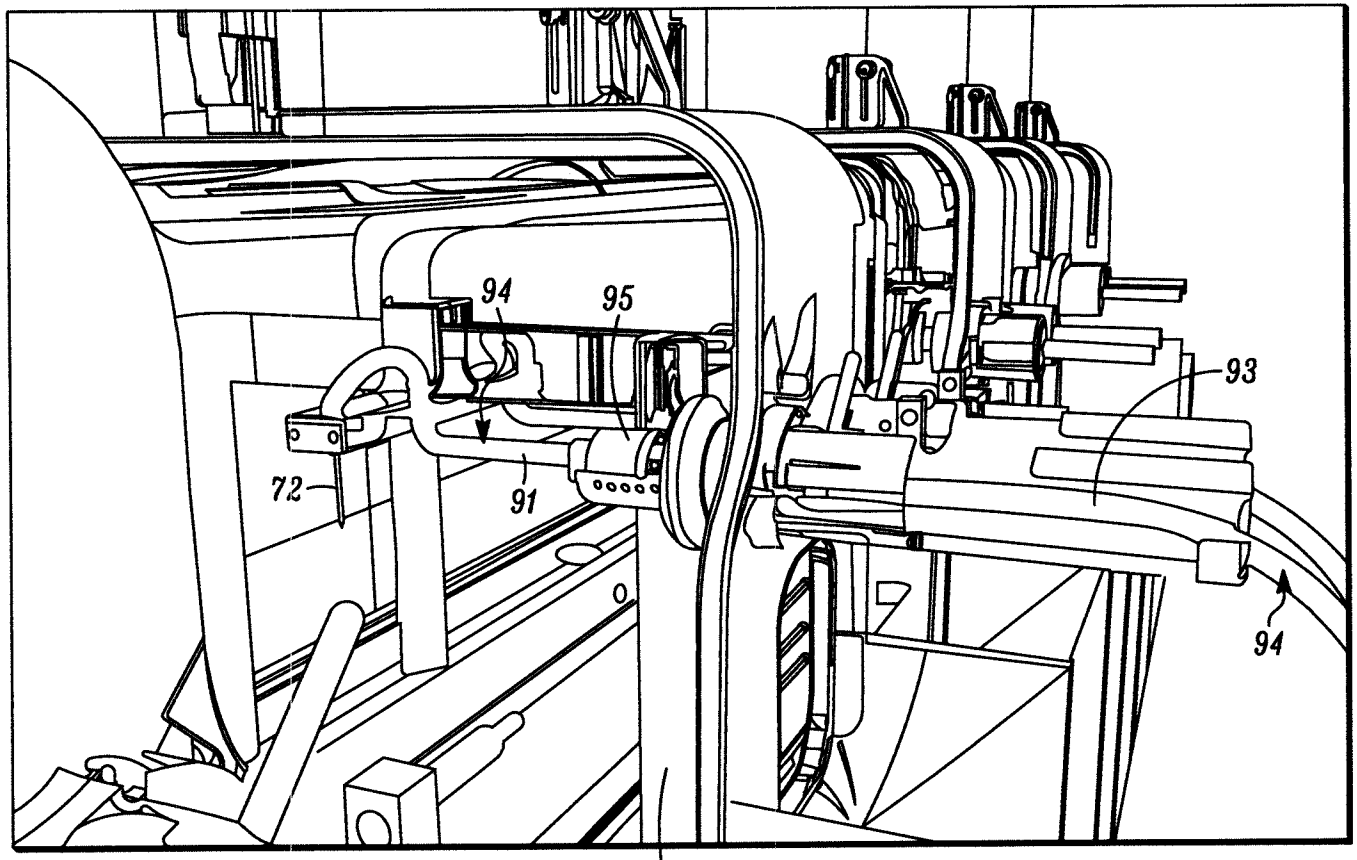
FIG. 14 is a perspective view of the first and second fluid conduits of a filling line and sterile connectors connecting the first and second fluid conduits to connect the injection member in fluid communication with a substance source.
Figure 15:
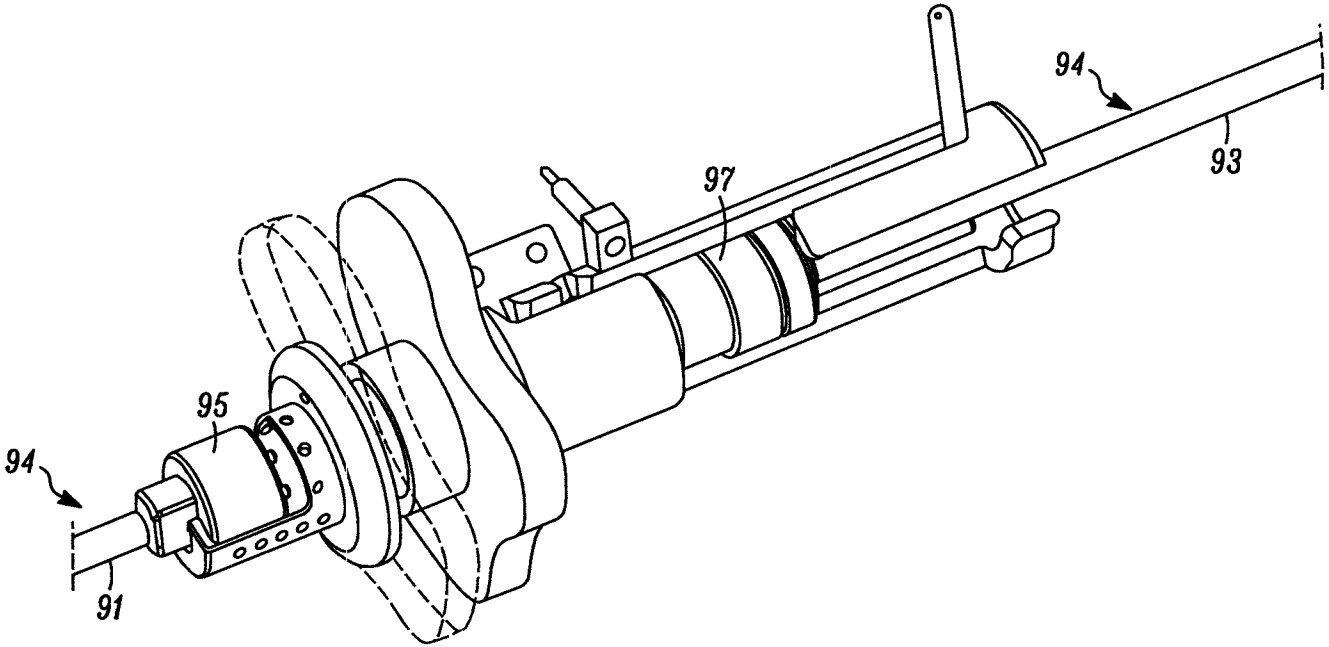
FIG. 15 is a perspective view of the sterile connectors of FIG. 14.

Each filling needle 72 can be connected in fluid communication to a substance source by one or more filling lines 94 for receiving therefrom a substance to be filled into the devices 12. In the illustrated embodiment, each filling line 94 includes a first fluid conduit 91 and a second fluid conduit 93, as shown in FIGS. 14 and 15. The first fluid conduit 91 is coupled to a filling needle 72 at one end and to a first sterile connector 95 at the other end. The second fluid conduit 93 is coupled to the substance source at one end and to a second sterile connector 97 at the other end. The first sterile connector 95 and the second sterile connector 97 are connectable to form a sealed sterile fluid connection therebetween, and thus connect the filling needle 72 in fluid communication with substance source.

It will be understood that any suitable sterile connector may be used to connect the substance source to the filling needles 72. In some embodiments, the first sterile connector 95 and the second sterile connector 97 are the first and second ports of a sterile DROC-type connector 96. The DROC-type connector 96 is described in U.S. patent application Ser. No. 13/080,537, filed Apr. 5, 2011, entitled "Aseptic Connector With Deflectable Ring of Concern and Method," which, in turn, claims the benefit of similarly titled U.S. Provisional Patent Application Ser. No. 61/320,857, filed Apr. 5, 2010, which are hereby incorporated by reference in their entireties as if explicitly set forth herein. As should be understood by those of ordinary skill in the pertinent art, other sterile/aseptic connectors may be utilized, such as, for example, those described in U.S. Provisional Patent Application Ser. No. 61/784,764, filed Mar. 14, 2013, entitled "Self Closing Connector;" similarly titled U.S. Provisional Patent Application Ser. No. 61/635,258, filed Apr. 18, 2012; similarly titled U.S. Provisional Patent Application Ser. No. 61/625,663, filed Apr. 17, 2013; U.S. Provisional Patent Application Ser. No. 61/794,255, filed Mar. 15, 2013, entitled "Device for Connecting or Filling and Method;" and similarly titled U.S. Provisional Patent Application Ser. No. 61/641,248, filed May 1, 2012, which are hereby incorporated by reference in their entireties as if explicitly set forth herein.

The substance source can be mounted external to the filling station 64, and the filling line(s) 94 connected between the substance source and the filling needles 72 are protected by suitable shielding, an electron trap, and/or other arrangement that is currently known, or later becomes known to those of ordinary skill in the pertinent art, to prevent radiation or energy from the sterilization station from degrading or otherwise damaging the substance flowing through the line(s) 94 from the substance source to the filling needles 72.

Figure 12A:
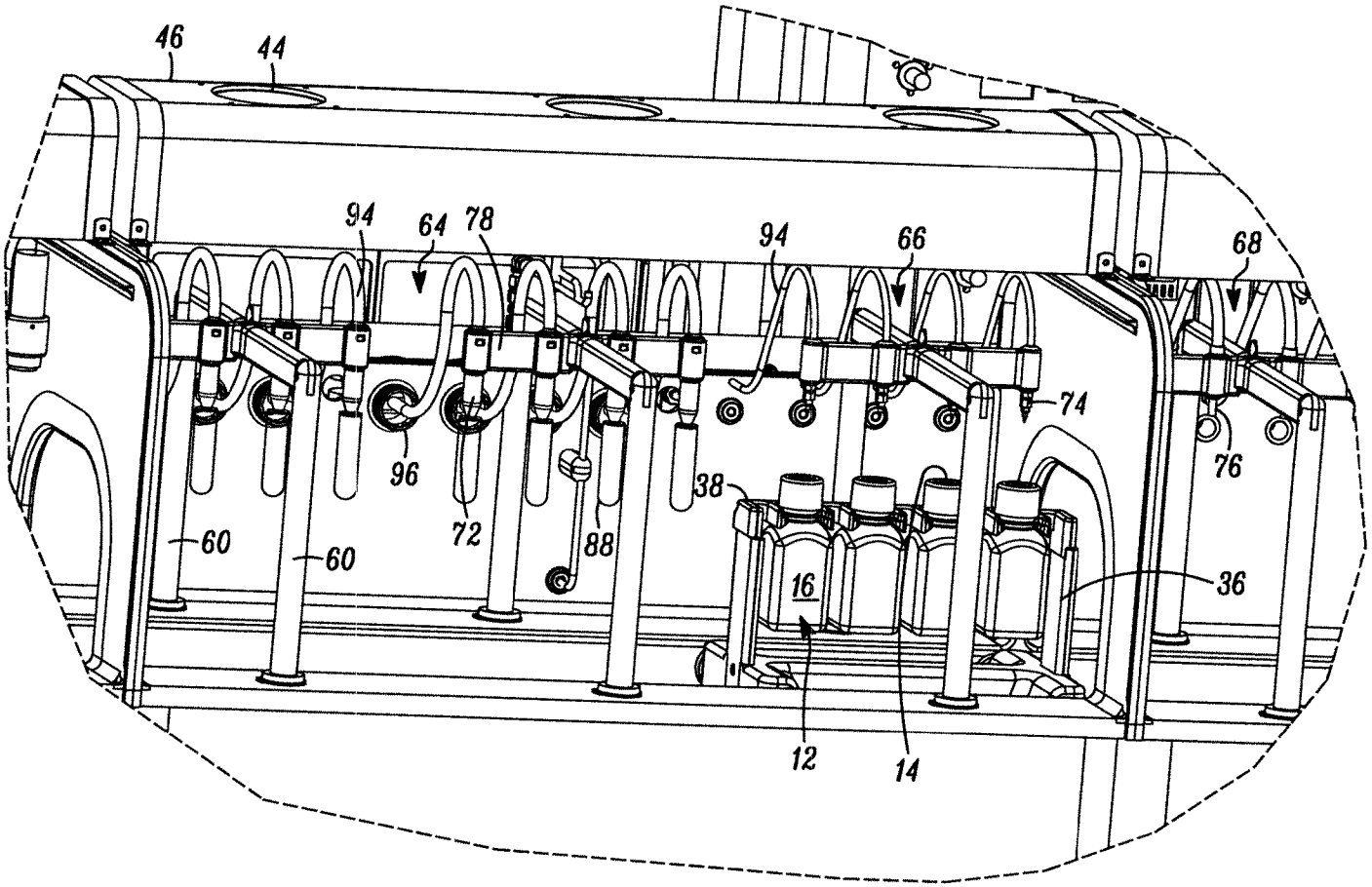
FIG. 12*a* is an angled front perspective view of the filling and resealing stations located within a module of the aseptic or sterile filling apparatus of FIG. 1, with a carriage carrying a set of the devices aligned with the resealing station therein, and with the liquid sealant dispensers in the raised position.

After the devices 12 have been filled with, e.g., a substantially metered amount of, substance, the devices are transported downstream from the filling station 64 to one or more resealing stations 66 as shown in FIG. 12*a*. In the illustrated embodiment, the resealing station 66 is located within the same module 22 as the filling station 64. However, the resealing station 66 may equally be located in a separate module or another location. In some embodiments, resealing of the container is accomplished, at least in part, through the use of a liquid sealant in the same or substantially similar manner as that disclosed in U.S. patent application Ser. No. 12/577,126, filed Oct. 9, 2009, entitled "Device with Co-Extruded Body and Flexible Inner Bladder and Related Apparatus and Method," which claims the benefit of similarly titled U.S. Provisional Patent Application Ser. No. 61/104,613, filed Oct. 10, 2008; U.S. patent application Ser. No. 12/901,420, filed Oct. 8, 2010, entitled "Device with Co-Molded Closure, One-Way Valve and Variable Volume Storage Chamber and Related Method," which claims the benefit of similarly titled U.S. Provisional Patent Application Ser. No. 61/250,363, filed Oct. 9, 2009; and U.S. Provisional Patent Application Ser. No. 61/476,523, filed Apr. 18, 2011, entitled "Filling Needle and Method," which are hereby expressly incorporated by reference in their entireties as part of the present disclosure. The resealing station 66 may be introduced immediately after the filling station 64 or elsewhere. In some embodiments, the device 12 arrives at the resealing station 66 after being pierced and filled with a substance using a non-coring filling needle at a filling station 64.

Figure 12B:
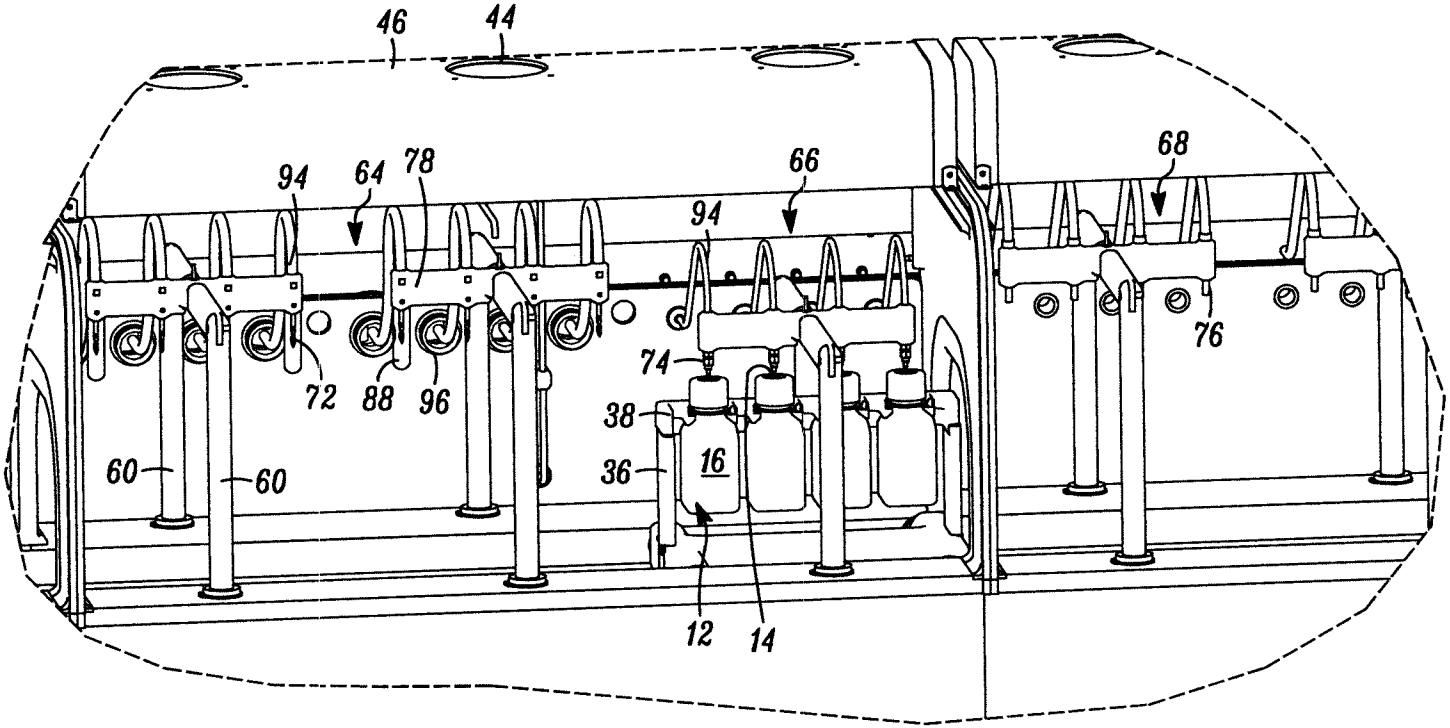
FIG. 12*b* is an angled front perspective view of the filling and resealing stations located within a module of the aseptic or sterile filling apparatus of FIG. 1, with a carriage carrying a set of the devices aligned with the resealing station therein, and with the liquid sealant dispensers in a lowered position to substantially evenly or uniformly dispense a substantially metered amount of liquid sealant onto the penetrated device septums.

At the resealing station 66, a plurality of liquid sealant dispensers 74 are supported by the first and second upstanding supports 60, which are moveable toward and away from a carriage 32 via a drive shaft 80 and drive motor 82 in the same manner as previously described with respect to the filling station 64. As shown in FIG. 12*b*, when a carriage 32 is properly aligned with the resealing station 66, the liquid sealant dispensers 74 are lowered to the appropriate level to dispense a liquid sealant to seal the septums 14 of the respective aligned devices 12. The liquid sealant dispensers 74 dispense a substantially metered amount of sealant onto the penetrated septum 14 to fully cover the septum. After the liquid sealant is dispensed, the sealant dispensers 74 are raised away from the carriage 32 and back to their original location. Movement of the liquid sealant dispensers 74 toward the devices 12 is helpful to evenly apply liquid sealant to a septum 14, especially when the liquid sealant includes a material having a high viscosity. Movement of the liquid sealant dispensers 74 away from the devices 12 breaks any filaments of the liquid sealant extending between a septum 14 and a liquid sealant dispenser 74 to allow the sealant to settle on the septum 14. Alternatively, the devices 12 may be moved relative to the dispenser 74. As may be recognized by those of ordinary skill in the pertinent art based on the teachings herein, the liquid sealant dispenser can be formed of any member, currently known, or that later becomes known, capable of dispensing a predetermined amount of sealant onto a target region, such as, for example, a suitable tube, a dropper, or pipette.

In some embodiments, the liquid sealant is applied at an approximately ambient or room temperature. However, the sealant may be applied at any suitable temperature. For example, a heated sealant may provide desired flow and/or viscosity characteristics. In some embodiments, the liquid sealant is a silicone, such as, for example, a medical grade liquid silicone. However, as may be recognized by those of ordinary skill in the pertinent art based on the teachings herein, the liquid sealant can take the form of any of numerous different sealants that are currently known, or that later become known. The sealant may be sufficiently viscous to prevent the liquid sealant from flowing through the penetrated region of a septum 14 and into the chamber 16 of a device 12 prior to curing the liquid sealant from the liquid phase to the solid phase. Additionally, the septum 14 can be configured to be sufficiently elastic to close upon itself after withdrawal of a filling needle 72 therefrom to substantially prevent the liquid sealant from flowing through the penetrated region of the septum 14 and into the chamber 16 of the device 12.

The resealing station 66 also includes a source of liquid sealant, or is connectable in fluid communication with a source of liquid sealant, such as, for example, a pressurized reservoir, and a pump 86, such as but not limited to the pump described in connection with the needle filling station 72, for pumping liquid sealant, e.g., metered amounts onto the penetrated septums 14 of the devices 12. As may be recognized for those of ordinary skill in the pertinent art, the pump may take the form of any of numerous other mechanisms for pumping or metering volumes or other measured amounts of liquid sealant for delivery onto the penetration portions of the devices, that are currently known, or that later become known, such as, for example, a piston pump, or other systems with pressurized liquid sealant and valves for releasing the pressurized sealant. For example, a valve, such as a specialty diaphragm valve may be connected in fluid communication between the liquid sealant source and the liquid sealant dispensers to control the weight and volume of the liquid sealant drops. The volume of the drops may be adjusted by an operator. The valves may also hold back the liquid sealant from the tips of the liquid sealant dispensers via a suck back feature to ensure a drip free environment.

Similar to as described previously with respect to the filling station 64, any suitable sterile connectors may be used to connect the liquid sealant source, the filling line(s) 94 and the liquid sealant dispensers 74. Similarly, the filling line(s) 94 may include a first fluid conduit 91 and a second fluid conduit 93, as shown in FIGS. 14 and 15. The first fluid conduit 91 is coupled to a liquid sealant dispenser at one end and to a first sterile connector 95 at the other end. The second fluid conduit 93 is coupled to the liquid sealant source at one end and to a second sterile connector 97 at the other end. The first sterile connector 95 and the second sterile connector 97 are connectable to form a sealed sterile fluid connection therebetween, and thus connecting the liquid sealant dispenser 74 in fluid communication with the liquid sealant source. Any one or a combination of the liquid sealant source, the filling line(s) 94 and the liquid sealant dispenser 74 may utilize a sterile DROC-type connector 96 or any of the sterile/aseptic connectors incorporated by reference above. The liquid sealant source can be mounted external to the resealing station 66 or within it, and the filling line(s) 94 connected between the substance source and the liquid sealant dispensers 74 can be protected by suitable shielding, an electron trap, and/or other arrangement that is currently known, or later becomes known to those of ordinary skill in the pertinent art, to prevent radiation from prematurely curing the liquid sealant prior to dispensing on a septum 14 of a device 12.

Figure 13:
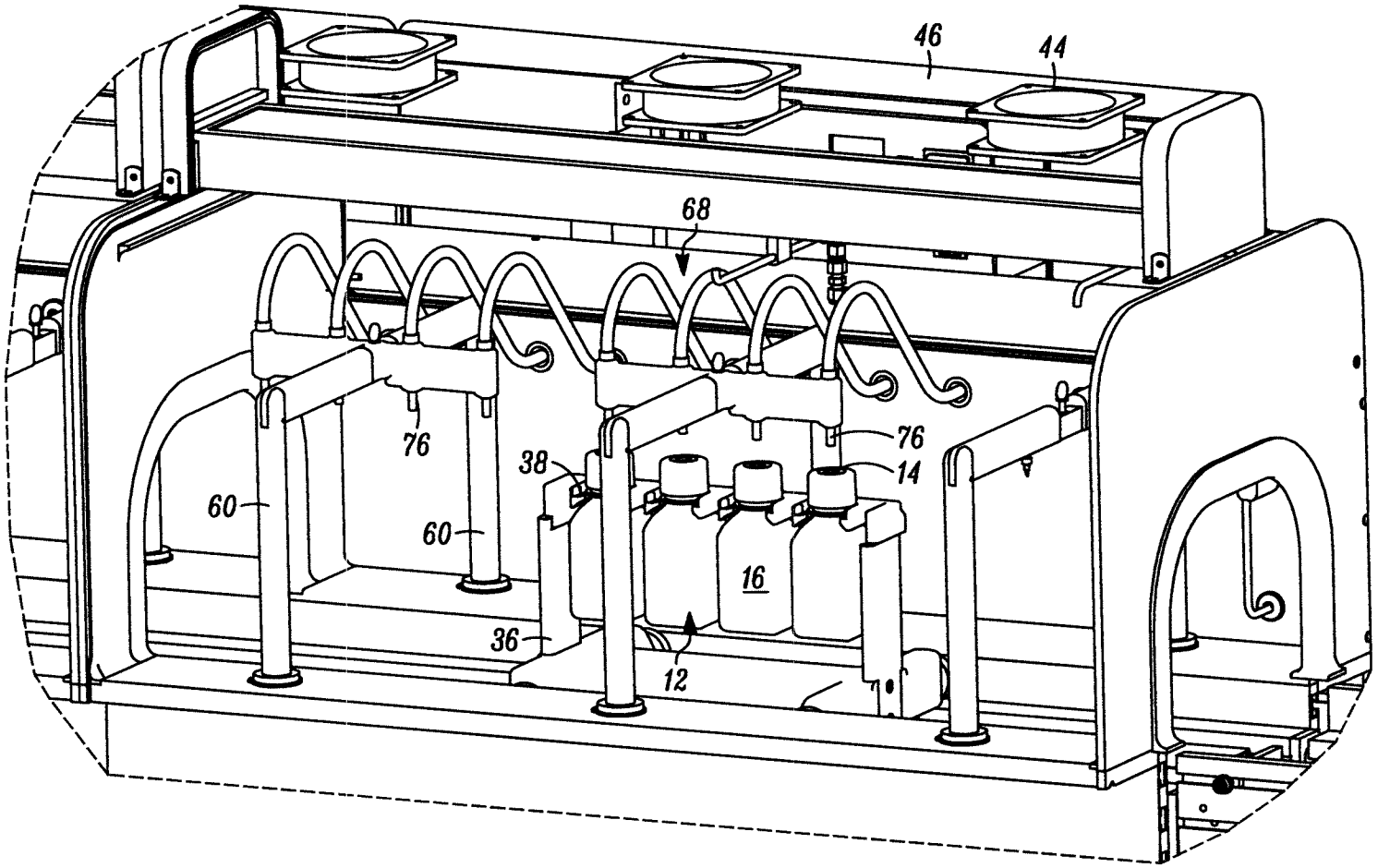
FIG. 13 is a front perspective view of a curing station located within a module of the aseptic or sterile filling apparatus of FIG. 1, with a carriage carrying a set of the devices aligned with the station therein to cure the liquid sealant and seal the device septums.

As shown in FIG. 13, after dispensing of the liquid sealant onto the device septums at the resealing station 66, the devices 12 are transported downstream to a curing station 68, wherein the sealant is exposed to a source of energy or radiation 75 to cure the liquid sealant. Any number of curing stations 68 may be disposed after the resealing station 66. Exposure of the liquid sealant to a suitable radiation or energy source will cure, e.g., accelerate, the liquid sealant from a liquid phase to a solid phase, thereby sealing the pierced septum 14 of the device 12 and hermetically sealing the filled substance within device from the ambient atmosphere. Radiation or energy curing of a liquid sealant provides several advantages over room temperature curing, such as ease of use, process consistency and significantly decreasing curing time, thus greatly increasing curing efficiency and device throughput.

Selection of a radiation or energy source is based upon the photoinitiator in the liquid sealant, which initiates curing of the sealant. Successful photoinitiator activation requires exposure to radiation or energy at a suitable wavelength or spectrum at sufficient intensity for a sufficient time. Therefore, the radiation or energy source should be selected to match the photoinitiator characteristics of the sealant. Alternatively, the sealant can be selected so that its photoinitiation characteristics compliment the radiation or energy source to be used.

As explained above, in some embodiments, a liquid silicone sealant is dispensed in the resealing station 66. With some such sealants, a UV wavelength within the range of about 300 nm to about 400 nm, such as a wavelength of approximately 365 nm, at an irradiation intensity greater than about 1 $W/cm^2$, such as greater than about 1.5 $W/cm^2$, is sufficient to activate the photoinitiator therein and successfully cure the sealant within an acceptable timeframe. In such embodiments, the radiation or energy source 75 is a UV source, and the emitting unit 76 emits UV radiation. In some such embodiments, curing of the liquid silicone from a liquid phase to a solid phase can be accomplished within a time period of less than about 30 seconds. In other such embodiments, the sealant, and radiation wavelength, intensity, and/or the sealant can be selected to accomplish curing in less than about 20 seconds.

In some embodiments, curing of the liquid silicone is accomplished by a two-stage process provided by way of two four-channel curing substations. The first curing substation utilizes a Light Emitting Diode (LED) driver delivering radiation to four 10 W collimator head units that amplify and emit the radiation onto the sealant. The second curing substation utilizes 200 W Xenon spot curing lamps delivering radiation to light guides that amplify and emit the radiation. When using the above-described sealant, both the LED collimator head units and the Xenon spot curing lamps provide a UV wavelength within the range of about 300 nm to about 400 nm, e.g., about 365 nm, to cure the liquid silicone. Utilizing this system, the sealant is cured for about 5 seconds under each of the two curing substations for a total of about 10 seconds. In some other embodiments, either the LED drivers/collimator head units combination or the Xenon spot curing lamps/light guides combination is utilized in both of the curing substations. Once the liquid sealant has been adequately cured and the devices sealed, the devices 12 are transported to the discharge station 31. It should be understood, though, that when using, for example, a UV curable sealant, that any suitable UV source can be used. For example, a UV laser can be used if the output matches the photoinitiator of the sealant.

An example of a suitable liquid silicone sealant for sealing the resealable portion is LOCTITE #5056 sealant, which photoinitiates at about 365 nm. Other suitable UV curable sealants are available from DYMAX, which photoinitiates at about 395 nm. Further sealants utilize 254 nm light. It should be noted, then, that UV curable sealants other than liquid silicone can be used, for example, acrylic-based UV curable sealants.

It should further be noted that liquid sealant other than those that are UV curable can be used to hermetically seal the penetrated septum, such as visible light (e.g., 400-436 nm) or infrared curable products, as are known or subsequently may become known. In such embodiments, the radiation or energy source is selected to generate an energy discharge or wavelength spectrum at sufficient intensity to cure the sealant within a desired time and based on process parameters and production requirements.

As may be recognized by those of ordinary skill in the pertinent art based on the teachings herein, numerous changes and modifications may be made to the above-described and other embodiments of the present invention without departing from its scope as defined in the claims. The aseptic or sterile filling apparatus 10 may include other workstations in addition to or in substitution of the workstations described herein. For example, prior to transportation of a device to the needle, other filling station, the interior chamber of a device may be sterilized in a sterilization station, such as by injecting a fluid sterilant therein, such as nitric oxide, in accordance with the teachings of U.S. Provisional Patent Application Ser. No. 61/499,626, filed Jun. 21, 2011, entitled "Nitric Oxide Injection Sterilization Device and Method," which is hereby expressly incorporated by reference in its entirety as part of the present disclosure.

Further each workstation may include alterative operational elements, which may be mounted in any of numerous different ways that are currently known, or that later become known, for performing the functions of the operational elements as described herein. For example, an electron beam source may be utilized in lieu of a UV source to decontaminate a device septum. Additionally, access to repair and/or replace a damaged operational element may be obtained via opening of the canopy. The spacing between the operational elements in the workstations may also be adjusted depending on the carriages used and the number of devices on each carriage. Accordingly, this detailed description of currently preferred embodiments is to be taken in an illustrative, as opposed to a limiting sense.

What is claimed is:

1. A method comprising the following steps:

(i) de-contaminating at least a penetrable surface of a device including a penetrable portion or septum defining the penetrable surface and pierceable by a piercing member, and a chamber sealed from ambient atmosphere and in fluid communication with the penetrable portion or septum;

(ii) moving one or more of a piercing member or the device relative to the other to pierce the penetrable portion or septum with the piercing member and thereby form a penetration through the penetrable portion or septum, introducing substance through the piercing member and into the chamber, and withdrawing the piercing member from the portion or septum;

(iii) applying a liquid sealant onto the portion or septum so that the liquid sealant is located on and covers the penetration;

(iv) converting the liquid sealant from a liquid phase to a solid phase and thereby hermetically sealing the penetration from ambient atmosphere with the solidified liquid sealant; and introducing filtered air or other gas over the device during each of steps (ii) through (iii), and applying a higher pressure of filtered air or other gas during step (ii) as compared to either of steps (i) or (iii).

2. A method as defined in claim 1, wherein step (iv) further includes applying radiation or energy to the liquid sealant and curing the liquid sealant from a liquid phase to a solid phase substantially at either about ambient temperature or about room temperature.

3. A method as defined in claim 2, wherein step (i) includes introducing the device into a de-contamination station and de-contaminating at least the penetrable surface of the penetrable portion or septum within the de-contamination station;

step (ii) includes moving the de-contaminated device into a dispensing station including at least one piercing member coupled in fluid communication with a source of substance to be introduced into the chamber of the device, moving one or more of the piercing member or the device relative to the other within the filling station to pierce the penetrable portion or septum with the piercing member, introducing substance through the piercing member and into the chamber, and withdrawing the piercing member from the portion or septum;

step (iii) includes moving the device from the dispensing station into a resealing station and applying a liquid sealant onto and covering therewith the penetration within the resealing station; and step (iv) includes moving the device from the resealing station into a curing station and applying radiation or energy to the liquid sealant to cure the liquid sealant from a liquid phase to a solid phase in the curing station.

4. A method as defined in claim 3, further comprising introducing filtered air or other gas within each of the de-contamination, dispensing, resealing and curing stations.

5. A method as defined in claim 4, further comprising introducing filtered air or other gas within the dispensing station at a higher pressure than in the de-contamination and curing stations to create a positive pressure gradient between the dispensing station and the de-contamination and curing stations.

6. A method as defined in claim 1 wherein step (i) includes achieving a sterility assurance level or SAL on the penetrable surface of the portion or septum of at least about log 3.

7. A method as defined in claim 1, wherein step (i) includes applying UV radiation to at least the penetrable surface of the portion or septum.

8. A method as defined in claim 7, wherein the UV radiation defines a wavelength within the range of about 240 nm to about 280 nm, and is applied at a power of about 60 Watts.

9. A method as defined in claim 1, wherein step (iv) includes applying UV radiation at a wavelength within the range of about 300 nm to about 400 nm, and at an irradiation intensity of at least about 1 $W/cm^2$.

10. A method as defined in claim 1, further comprising curing the liquid sealant from a liquid phase to a solid phase within a time period of less than one minute.

11. A method as defined in claim 10, wherein the time period is less than ½ minute.

12. A method as defined in claim 11, wherein the time period is less than ⅓ minute.

13. A method as defined in claim 1, further comprising introducing filtered air or other gas over the device during each of steps (i) through (iv).

14. A method as defined in claim 1, wherein the penetrable portion or septum is sufficiently elastic to close itself after withdrawal of the piercing member from the portion or septum and substantially prevent liquid sealant from flowing through the penetration and into the chamber of the device.

15. A method as defined in claim 1, wherein the liquid sealant is sufficiently viscous to prevent liquid sealant from flowing through the penetration and into the chamber of the device prior to converting the liquid sealant from the liquid phase to the solid phase.

16. A method, comprising:

(i) piercing a penetrable portion or septum, that at least partially defines a chamber of a device sealed from ambient atmosphere, with a piercing member to form a penetration through the penetrable portion or septum;

(ii) introducing substance through the piercing member and into the chamber;

(iii) withdrawing the piercing member from the portion or septum;

(iv) applying a liquid sealant onto the portion or septum so that the liquid sealant is located on and covers the penetration;

(v) converting the liquid sealant from a liquid phase to a solid phase and thereby hermetically sealing the penetration from ambient atmosphere with the solidified liquid sealant;

(vi) de-contaminating at least a portion of an exterior surface of the penetrable portion or septum prior to the piercing step; and introducing filtered air or other gas over the device during each of steps (i) through (vi), and applying a higher pressure of filtered air or other gas during steps (i) through (iii) as compared to any of steps (iv) though (vi).

17. A method as defined in claim 16, wherein step (vi) includes achieving a sterility assurance level or SAL on the portion or septum of at least about log 3.

18. A method as defined in claim 16, wherein step (vi) includes applying UV radiation to the portion or septum.

19. A method as defined in claim 18, wherein the UV radiation defines a wavelength within the range of about 240 nm to about 280 nm, and is applied at a power of about 60 Watts.

20. A method as defined in claim 16, wherein step (v) includes applying UV radiation to the portion or septum.

21. A method as defined in claim 16, wherein the penetrable portion or septum is sufficiently elastic to close itself after withdrawal of the piercing member from the portion or septum and substantially prevent liquid sealant from flowing through the penetration and into the chamber of the device.

22. A method as defined in claim 16, wherein the liquid sealant is sufficiently viscous to prevent liquid sealant from flowing through the penetration and into the chamber of the device prior to converting the liquid sealant from the liquid phase to the solid phase.

23. An apparatus, comprising:

a dispensing station that is either coupled or connectible in fluid communication with a source of substance to be introduced into a chamber of a device that is sealed from ambient atmosphere;

a piercing member within the dispensing station that is movable relative to the device, or vice versa, to (i) pierce a penetrable portion or septum of the device with the piercing member to form a penetration through the penetrable portion or septum, (ii) introduce substance from the source through the piercing member and into the chamber, and (iii) withdraw the piercing member from the portion or septum;

a de-contamination station configured to receive therein the device and de-contaminate at least a portion of an exterior surface of the penetrable portion or septum, wherein the de-contamination station includes at least one source of UV radiation configured to apply UV radiation to the exterior surface of the portion or septum; and a resealing station including at least one liquid sealant dispenser that is either coupled or connectible in fluid communication with a source of liquid sealant for applying liquid sealant onto and covering therewith the penetration, wherein the liquid sealant is convertible from a liquid phase to a solid phase, and for thereby hermetically sealing the penetration with solidified liquid sealant.

24. An apparatus as defined in claim 23, wherein the liquid sealant is convertible from the liquid phase to the solid phase by applying UV radiation.

25. An apparatus as defined in claim 23, wherein the UV radiation defines a wavelength within the range of about 240 nm to about 280 nm, and is applied at a power of about 60 Watts.

26. An apparatus as defined in claim 23, further comprising at least one source of filtered air or other gas coupled in fluid communication with the de-contamination, dispensing, and resealing stations and configured for introducing sterile air or other gas within each station.

27. An apparatus as defined in claim 26, wherein the at least one source of filtered air or other gas introduces filtered air or other gas within the dispensing station at a higher pressure than in the de-contamination and resealing stations to create a positive pressure gradient between the dispensing station and the de-contamination and resealing stations.

28. An apparatus as defined in claim 23, further comprising (i) a first sterile connector coupled in fluid communication with the piercing member and a second sterile connector coupled in fluid communication with the source of substance to be introduced, wherein the first sterile connector is connectable to the second sterile connector to form a sealed sterile fluid connection therebetween, and (ii) a third sterile connector coupled in fluid communication with the liquid sealant dispenser and a fourth sterile connector coupled in fluid communication with the source of liquid sealant, wherein the third sterile connector is connectable to the fourth sterile connector to form a sealed sterile fluid connection therebetween.

29. An apparatus comprising:

a conveyor defining a path for transporting at least one device along the path, wherein each device includes a penetrable portion or septum, penetrable by a dispensing member, and a chamber sealed with respect to ambient atmosphere and in fluid communication with the penetrable portion or septum;

a de-contamination station located on the conveyor path and configured to receive therein the device and de-contaminate at least a portion of an exterior surface of the penetrable portion or septum;

a dispensing station located on the conveyor path downstream of the de-contamination station and including at least one dispensing member coupled or connectible in fluid communication with a source of substance to be introduced into the chamber of the device, wherein one or more of the dispensing member or the device is movable relative to the other within the dispensing station to penetrate the penetrable portion or septum with the dispensing member, introduce substance through the dispensing member and into the chamber, and withdraw the dispensing member from the portion or septum; and a resealing station located on the conveyor path downstream of the dispensing station and including at least one liquid sealant dispenser coupled or connectible in fluid communication with a source of liquid sealant and applying a liquid sealant onto a region of the portion or septum penetrated by the dispensing member.

30. An apparatus as defined in claim 29, wherein the de-contamination station includes at least one source of UV radiation configured to apply UV radiation to at least the exterior surface of the portion or septum.

31. An apparatus as defined in claim 30, wherein the UV radiation defines a wavelength within the range of about 240 nm to about 280 nm, and is applied at a power of about 60 Watts.

32. An apparatus as defined in claim 29, further comprising a frame and a plurality of modules mounted on the frame, wherein each module includes one or more of a de-contamination station, dispensing station, or resealing station.

33. An apparatus as defined in claim 32, wherein each module further includes a respective portion of the conveyor.

34. An apparatus as defined in claim 32, wherein at least one of the modules includes a plurality of stations.

35. An apparatus as defined in claim 34, wherein a first module includes a plurality of de-contamination stations, a second module located downstream of the first module on the conveyor path includes a plurality of dispensing stations, and a third module located downstream of the second module on the conveyor path includes a plurality of resealing stations.

36. An apparatus as defined in claim 29, further comprising (i) a first sterile connector and first fluid conduit coupled between the first sterile connector and the dispensing member, and a second sterile connector and a second fluid conduit coupled between the second sterile connector and a source of substance to be introduced, wherein the first sterile connector is connectable to the second sterile connector to form a sealed sterile fluid connection therebetween, and (ii) a third sterile connector and third fluid conduit coupled between the third sterile connector and the liquid sealant dispenser, and a fourth sterile connector and a fourth fluid conduit coupled between the fourth sterile connector and a source of liquid sealant, wherein the third sterile connector is connectable to the fourth sterile connector to form a sealed sterile fluid connection therebetween.

37. An apparatus as defined in claim 29, wherein the dispensing station includes a mount including a plurality of dispensing members laterally spaced relative to each other and fixedly mounted thereon, and a plurality of caps, wherein each cap is releasably connected to the mount in a position covering a respective dispensing member, and the mount is relatively movable toward and away from the conveyor, and wherein the conveyor includes a cap fixture including a plurality of cap support surfaces engagable with respective caps when the mount is moved relatively toward the conveyor to releasably retain the caps thereon, and disengage the caps from the mount when the mount is moved away from the conveyor to expose the dispensing members and ready them for use.

38. A method as defined in claim 1, wherein the applying step comprises applying a heated liquid sealant.

39. A method as defined in claim 16, wherein the applying step comprises applying a heated liquid sealant.

40. An apparatus as defined in claim 23, wherein the liquid sealant is a heated liquid sealant.

41. An apparatus as defined in claim 29, wherein the liquid sealant is a heated liquid sealant.

42. An apparatus, comprising:

a dispensing station that is either coupled or connectible in fluid communication with a source of substance to be introduced into a chamber of a device that is sealed from ambient atmosphere;

a piercing member within the dispensing station that is movable relative to the device, or vice versa, to (i) pierce a penetrable portion or septum of the device with the piercing member to form a penetration through the penetrable portion or septum, (ii) introduce substance from the source through the piercing member and into the chamber, and (iii) withdraw the piercing member from the portion or septum;

a resealing station including at least one liquid sealant dispenser that is either coupled or connectible in fluid communication with a source of liquid sealant for applying liquid sealant onto and covering therewith the penetration, wherein the liquid sealant is convertible from a liquid phase to a solid phase, and for thereby hermetically sealing the penetration with solidified liquid sealant; and (i) a first sterile connector coupled in fluid communication with the piercing member and a second sterile connector coupled in fluid communication with the source of substance to be introduced, wherein the first sterile connector is connectable to the second sterile connector to form a sealed sterile fluid connection therebetween, and (ii) a third sterile connector coupled in fluid communication with the liquid sealant dispenser and a fourth sterile connector coupled in fluid communication with the source of liquid sealant, wherein the third sterile connector is connectable to the fourth sterile connector to form a sealed sterile fluid connection therebetween.

* * * * *